US012800258B2

(12) United States Patent
Cudal et al.

(10) Patent No.: US 12,800,258 B2
(45) Date of Patent: Nov. 17, 2026

(54) GRIP AND FRAME ADAPTER FOR AIRSOFT GUN

(71) Applicants: Renfield Cudal, West Palm Beach, FL (US); Arren Cudal, West Palm Beach, FL (US)

(72) Inventors: Renfield Cudal, West Palm Beach, FL (US); Arren Cudal, West Palm Beach, FL (US)

( * ) Notice: Subject to any disclaimer, the term of this patent is extended or adjusted under 35 U.S.C. 154(b) by 0 days.

(21) Appl. No.: 19/245,297

(22) Filed: Jun. 21, 2025

(65) Prior Publication Data

US 2025/0314448 A1 Oct. 9, 2025

Related U.S. Application Data

(63) Continuation-in-part of application No. 18/396,326, filed on Dec. 26, 2023, now Pat. No. 12,455,139, which is a continuation-in-part of application No. 18/455,304, filed on Aug. 24, 2023, now Pat. No. 12,292,253, which is a continuation-in-part of application No. 18/327,010, filed on May 31, 2023, now Pat. No. 11,913,750.

(51) Int. Cl.
*F41B 11/723* (2013.01)
*F41B 11/62* (2013.01)
*F41B 11/73* (2013.01)

(52) U.S. Cl.
CPC ..... *F41B 11/723* (2013.01); *F41B 11/62* (2013.01); *F41B 11/73* (2013.01)

(58) Field of Classification Search
CPC ..... F41B 11/723; F41B 11/62
USPC ..... 124/75
See application file for complete search history.

(56) References Cited

U.S. PATENT DOCUMENTS 2,110,509 A * 3/1938 Von Latscher-Latka ..... F41B 11/55 124/58
2,881,752 A * 4/1959 Blahnik ..... F41B 11/51 124/75
5,711,286 A * 1/1998 Petrosyan ..... F41B 11/55 124/76
7,267,119 B2 * 9/2007 Maeda ..... F41B 11/723 124/76

(Continued)

FOREIGN PATENT DOCUMENTS

EP 1503166 A1 * 2/2005 ..... F41B 11/721
EP 2860485 A1 * 4/2015 ..... F41B 11/71

*Primary Examiner* — Samir Abdosh
(74) *Attorney, Agent, or Firm* — Mark Terry

(57) ABSTRACT

An adapter for airsoft guns includes a housing comprising a single, integrally formed plastic element, the housing having an upper portion configured to mate with a magazine well of the airsoft gun, an air reservoir located within the housing for holding pressurized gas, an air inlet configured for allowing ingress of pressurized air from an attached gas canister, an air outlet configured for allowing egress of pressurized air from the air reservoir, a piston valve between the air reservoir and the air outlet configured for preventing airflow from the air reservoir to the air outlet when in the rest position, and allowing temporary airflow from the air reservoir to the air outlet when contacted by a firing pin of the airsoft gun, a projectile inlet configured for allowing ingress of projectiles from an attached projectile magazine, and a projectile outlet configured for allowing egress of projectiles to the airsoft gun.

10 Claims, 40 Drawing Sheets

(56) References Cited

U.S. PATENT DOCUMENTS

| | | | | |
|---|---|---|---|---|
| 9,885,537 | B2 * | 2/2018 | Tippmann, Jr. | F41B 11/723 |
| 10,139,192 | B1 * | 11/2018 | Baghadjian | F41B 11/55 |
| 12,276,476 | B1 * | 4/2025 | Riley | F41B 11/62 |
| 2007/0181116 | A1 * | 8/2007 | Wei | F41B 11/723 124/74 |
| 2009/0277436 | A1 * | 11/2009 | Wei | F41B 11/723 124/74 |
| 2010/0224180 | A1 * | 9/2010 | Tippmann, Jr. | F41B 11/62 124/74 |
| 2012/0192846 | A1 * | 8/2012 | Rice | F41B 11/57 124/73 |
| 2014/0165984 | A1 * | 6/2014 | Colby | F41B 11/723 124/73 |
| 2015/0007804 | A1 * | 1/2015 | Tippmann, Jr. | F41B 11/70 124/73 |
| 2015/0300771 | A1 * | 10/2015 | Tseng | F41B 11/62 124/74 |
| 2017/0160046 | A1 * | 6/2017 | Shen | F41B 11/642 |
| 2017/0211906 | A1 * | 7/2017 | Colby | F41B 11/723 |
| 2017/0276451 | A1 * | 9/2017 | Kang | F41B 11/646 |
| 2023/0036552 | A1 * | 2/2023 | Straka | F41B 11/55 |
| 2025/0067537 | A1 * | 2/2025 | Cudal | F41B 11/62 |
| 2025/0237467 | A1 * | 7/2025 | Riley | F41B 11/56 |

* cited by examiner

GRIP AND FRAME ADAPTER FOR AIRSOFT GUN

CROSS-REFERENCE TO RELATED APPLICATIONS

This patent application is a continuation in part of, and claims priority to, patent application Ser. No. 18/396,326 filed Dec. 26, 2023, which is a continuation in part of patent application Ser. No. 18/455,304 filed Aug. 24, 2023, which is a continuation in part of patent application Ser. No. 18/327,010 filed Mar. 31, 2023. The subject matter of patents application Ser. Nos. 18/396,326, 18/455,304, 18/327,010 are incorporated by reference in their entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to the airsoft gun industry and, more specifically, relates to the field of products and accessories for guns used in the sport of airsoft.

BACKGROUND

Airsoft guns operate on a wholly different principle than gunpowder powered firearms. Gas-powered airsoft guns, a favored choice among many enthusiasts, work on a simple, yet effective principle: they use compressed gas to propel the plastic projectiles, otherwise known as BBs. This gas, often referred to as 'green gas' (a propane-based mixture) or $CO^2$, is stored in a canister or cartridge that is usually housed within the magazine or the grip of the gun. When the trigger is pulled, a valve on the gas canister or cartridge opens, releasing a measured burst of gas. This gas expands rapidly and drives the BB down the barrel of the gun and out towards the target. Due to their design, gas-powered guns are capable of semi-automatic and fully automatic fire.

Key components in a gas-powered airsoft gun include the gas canister or cartridge, the magazine, the BBs, and the firing mechanism. The gas canister is a reservoir that holds the pressurized gas, which can be refilled or replaced depending on the design of the gun. The magazine, besides housing the gas canister in some designs, also holds the BBs, and feeds them into the firing chamber. The firing mechanism, also known as the bolt in some designs, strikes the release valve on the gas canister when the trigger is pulled, allowing gas to propel the BB. The BBs themselves are usually small in diameter and made of plastic, with different weights available to cater to different needs and preferences in terms of range and accuracy.

There are several problems that have arisen regarding compatibility of airsoft gun components. One of the primary compatibility issues in gas-powered airsoft guns is related to the gas canisters. Gas-powered guns can be designed to use either 'green gas' or $CO^2$ canisters, and while some guns are adaptable and can use both types, many are not. This means that a green gas canister will not fit or function in a $CO^2$ gun and vice versa. Further, even within the same type of gas, canisters from different manufacturers can differ in size, shape, and valve type, making them incompatible with certain guns. This lack of standardization can be frustrating for airsoft enthusiasts, as it restricts their options and can lead to additional costs if a specific brand or type of canister is more expensive or harder to obtain.

The BBs and magazines pose further compatibility issues. In terms of BBs, most airsoft guns are designed to fire standard size BBs, but the weight of the BBs can significantly affect performance, and not all guns are capable of effectively firing the heavier or lighter variants. This means that players often need to experiment with BBs from different manufacturers to find the ones that work best with their specific gun. As for magazines, there is a notable lack of cross-compatibility between different brands and models. An airsoft gun will usually only accept a magazine designed specifically for that model, or occasionally, a series of models from the same manufacturer. This can be problematic if magazines for a particular model are discontinued or hard to find, and it also prevents players from being able to share magazines during games, even if they are using similar types of gas-powered guns. This absence of universal compatibility presents ongoing challenges for airsoft enthusiasts.

Another compatibility issue involves gas blowback features. A gas blowback airsoft gun is a type of airsoft gun that has a realistic blowback action on the top slide of the pistol. When fired, the slide will kick back with recoil in the same way as a real pistol, making it a popular choice among experienced or professional players due to the realistic action. Gas airsoft rifles are also available, boasting high feet per second power and close attention to detail when it comes to realism. But again, there is a lack of gas blowback cross-compatibility between different brands and models. Some airsoft guns will only exhibit gas blowback features if certain canisters, adapters, connectors, or magazines are used. This can be problematic for users that desire gas blowback features.

Therefore, a need exists to overcome the problems with the prior art as discussed above, and particularly for a more efficient and user-friendly way of making airsoft components and their features compatible with each other.

SUMMARY

A grip and frame adapter for airsoft guns is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, an adapter for airsoft guns is provided that solves the above-described problems. The adapter for airsoft guns includes) a housing comprising a single, integrally formed plastic element, the housing defining a frame configured to house operating parts of the airsoft gun, the housing further including a trigger guard and a magazine well configured for mating with a projectile magazine, an air reservoir located within the housing, the air reservoir for holding pressurized gas, an air inlet located near a bottom of the housing, the air inlet coupled with the air reservoir and configured for allowing ingress of pressurized air from an attached gas canister, an air outlet located near a top of the housing, the air outlet coupled with the air reservoir and configured for allowing egress of pressurized air from the air reservoir to the airsoft gun, a projectile inlet in the magazine well of the housing, the projectile inlet configured for allowing ingress of projectiles from an attached projectile magazine, and, a projectile outlet located near the top of the housing, the projectile outlet coupled with the projectile inlet and configured for allowing egress of projectiles from the adapter.

Additional aspects of the disclosed embodiments will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
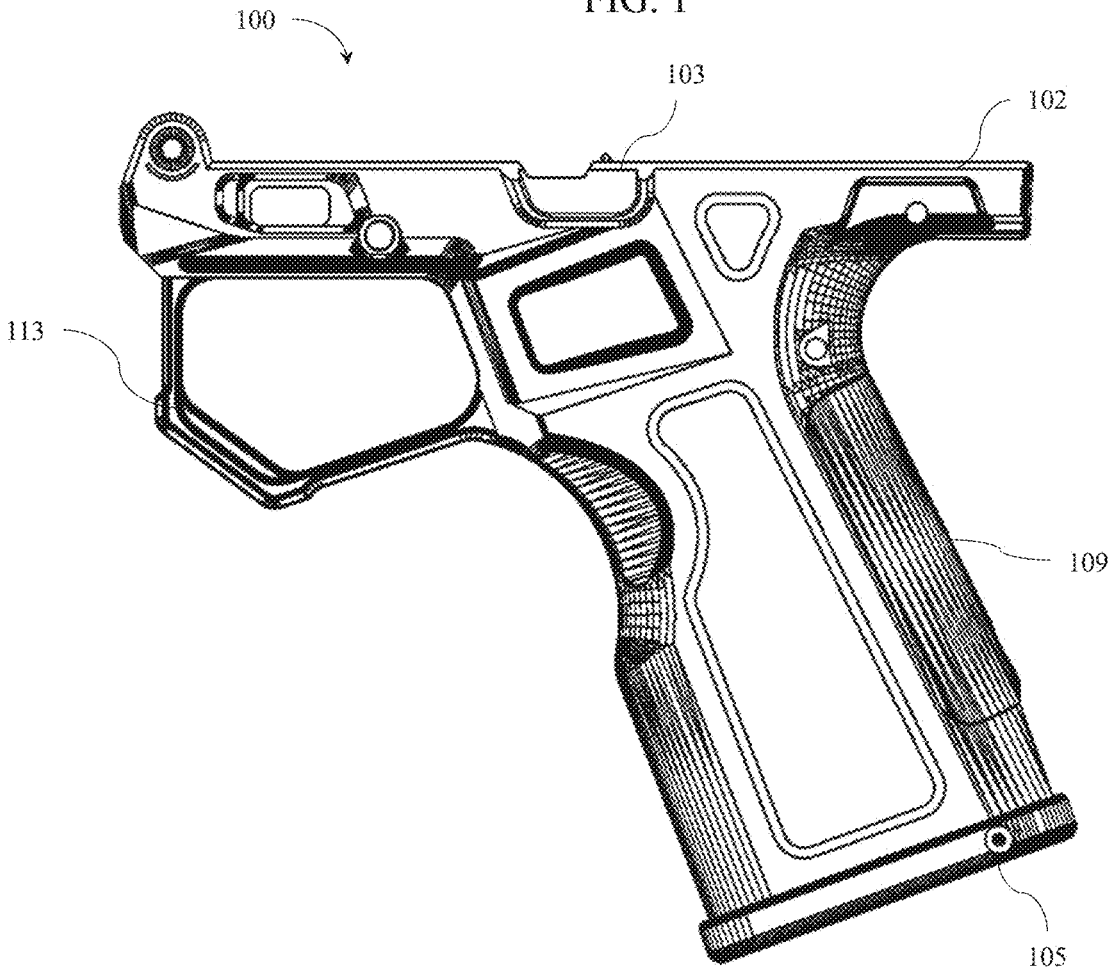
FIG. 1 depicts a left-side view of a grip and frame adapter for airsoft guns, according to a first embodiment.

The following detailed description refers to the accompanying drawings. Wherever possible, the same reference numbers are used in the drawings and the following description to refer to the same or similar elements. While embodiments of the claimed subject matter may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed subject matter improves over the prior art by providing a grip and frame adapter for airsoft guns that increases the compatibility of the airsoft gun. The claimed subject matter presents an inexpensively manufactured adapter that can be used with a variety of different components, operating parts, gas canisters and magazines, which increases the usability of the airsoft gun. The claimed subject matter presents a significant breakthrough in the realm of airsoft sport by addressing the long-standing issue of component compatibility. The claimed subject matter enhances the flexibility and customization options for airsoft users by allowing a gas-powered airsoft gun to utilize a variety of different components, operating parts, gas canisters and magazines from various different manufacturers, while still retaining gas blowback features. By introducing such compatibility, one increases the range of choices available to airsoft users, and also reduces costs associated with sourcing specific, possibly rare, or expensive, brand-dedicated components. The claimed subject matter democratizes the usage of different components, operating parts, gas canisters and magazines, liberating users from the constraints of proprietary design.

Moreover, the claimed subject matter reshapes the strategic dynamics of airsoft games. Using the claimed device, players can now more easily share resources during matches, lending their different components, operating parts, magazines, or gas canisters to teammates as needed, thereby promoting cooperation and improving team tactics. With the problem of compatibility being reduced or eliminated, more focus can be put on the actual gameplay and tactics, enhancing the overall experience for airsoft players. Additionally, the ability to experiment freely with different types of different components, operating parts, gas canisters and magazines without worrying about compatibility could foster increased innovation and customization within the sport. The claimed subject matter serves as a step forward in the evolution of airsoft, enhancing player experience, fostering camaraderie, and driving the sport's continual growth.

Figure 2:
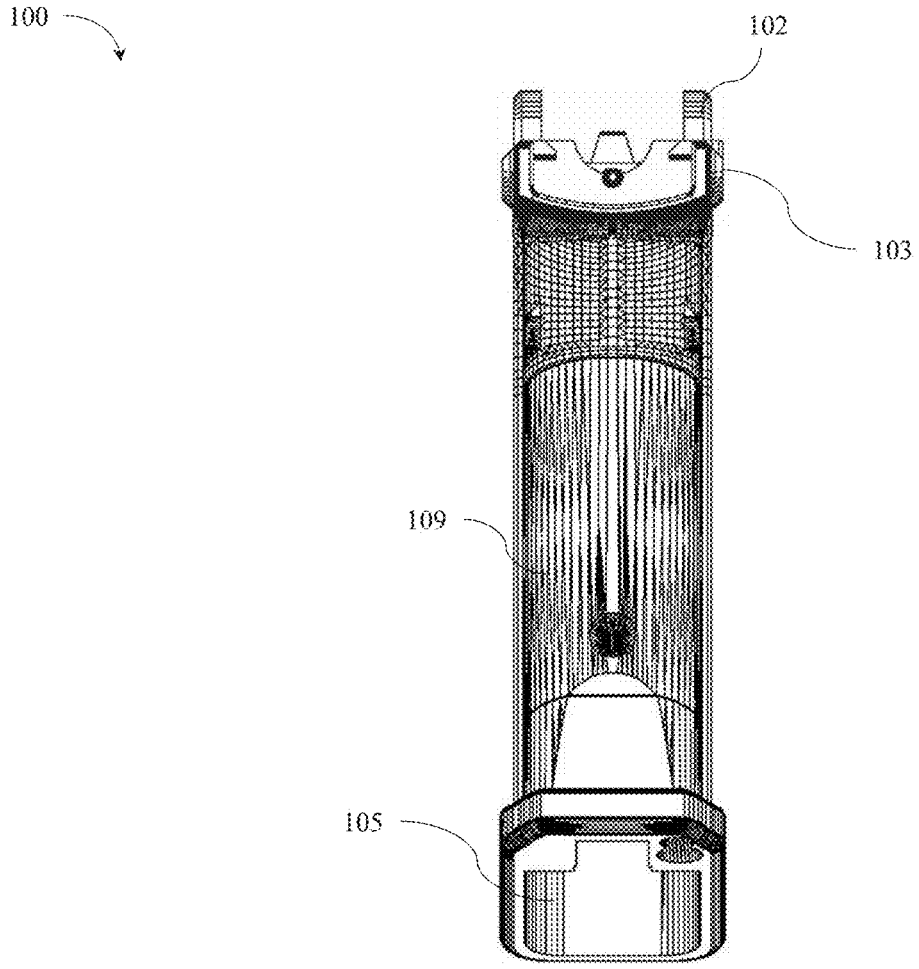
FIG. 2 depicts a rear view of the grip and frame adapter for airsoft guns, according to the first embodiment.
Figure 3:
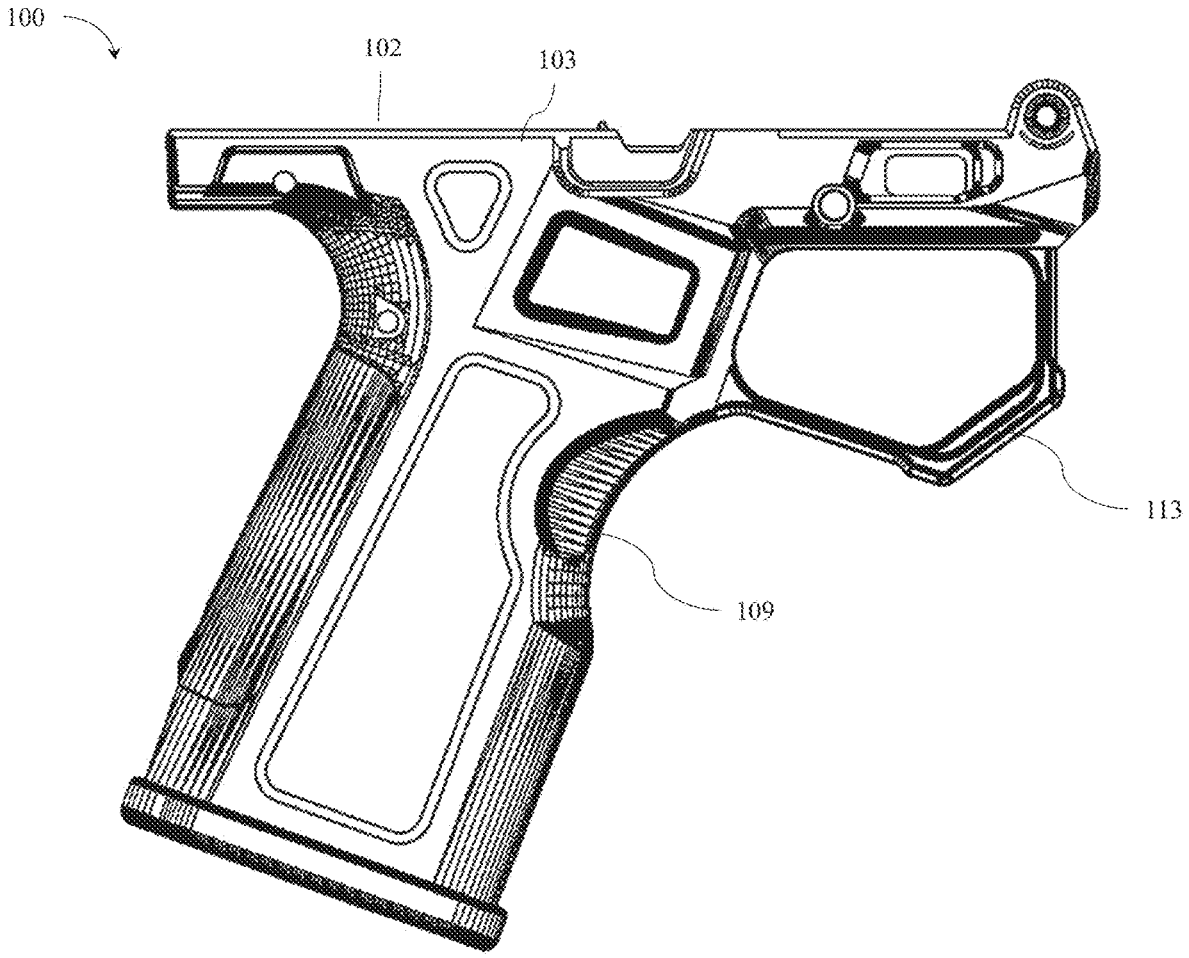
FIG. 3 depicts a right-side view of the grip and frame adapter for airsoft guns, according to the first embodiment.
Figure 4:
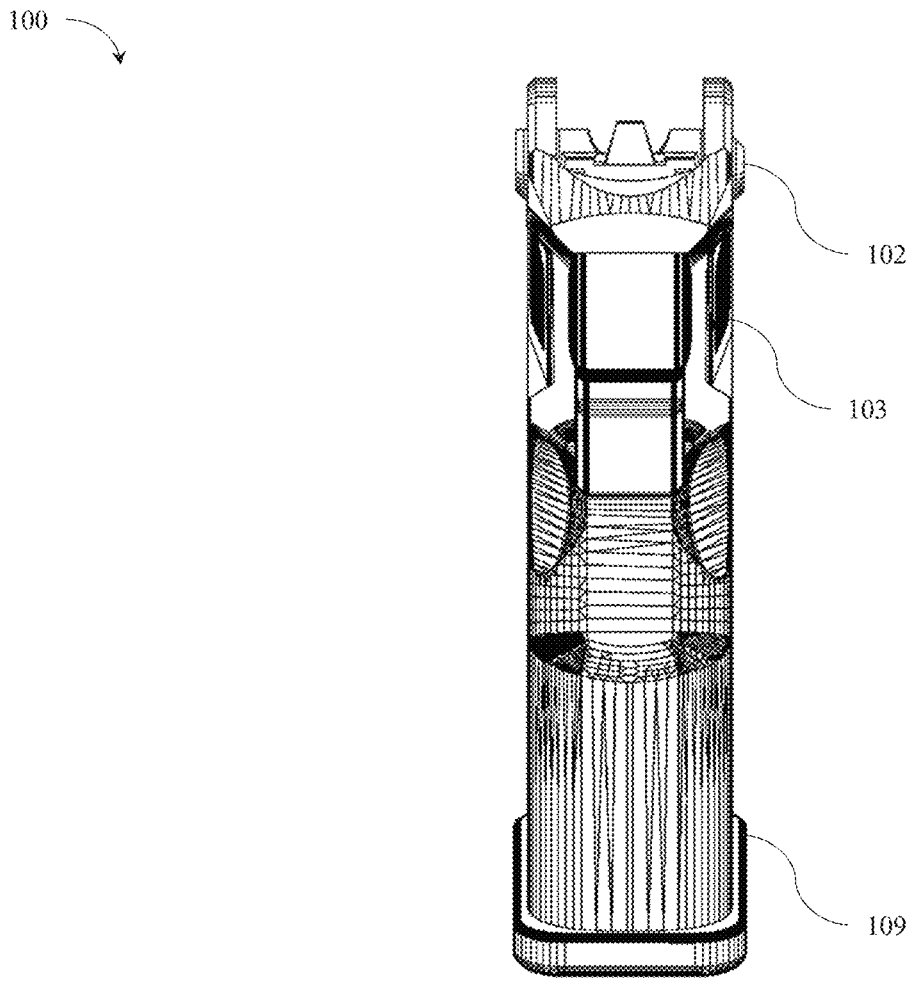
FIG. 4 depicts a front view of the grip and frame adapter for airsoft guns, according to the first embodiment.
Figure 5:
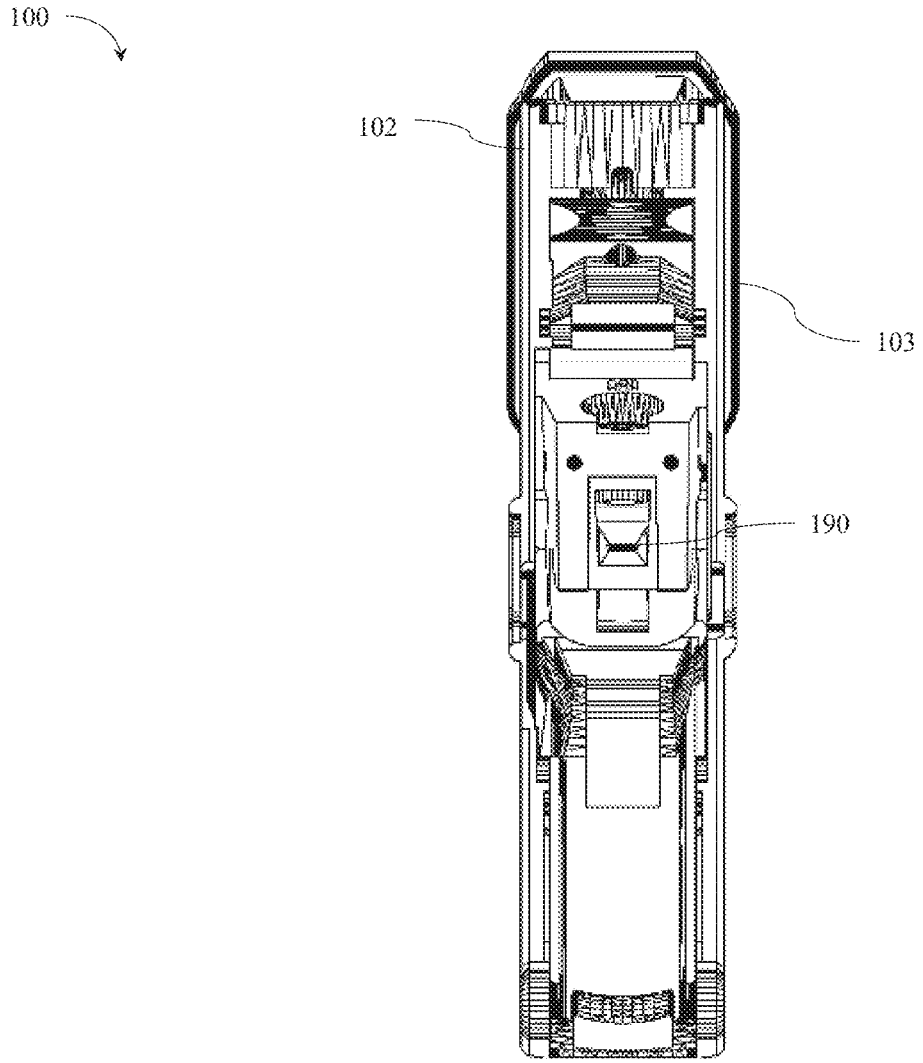
FIG. 5 depicts a top view of the grip and frame adapter for airsoft guns, according to the first embodiment.
Figure 6:
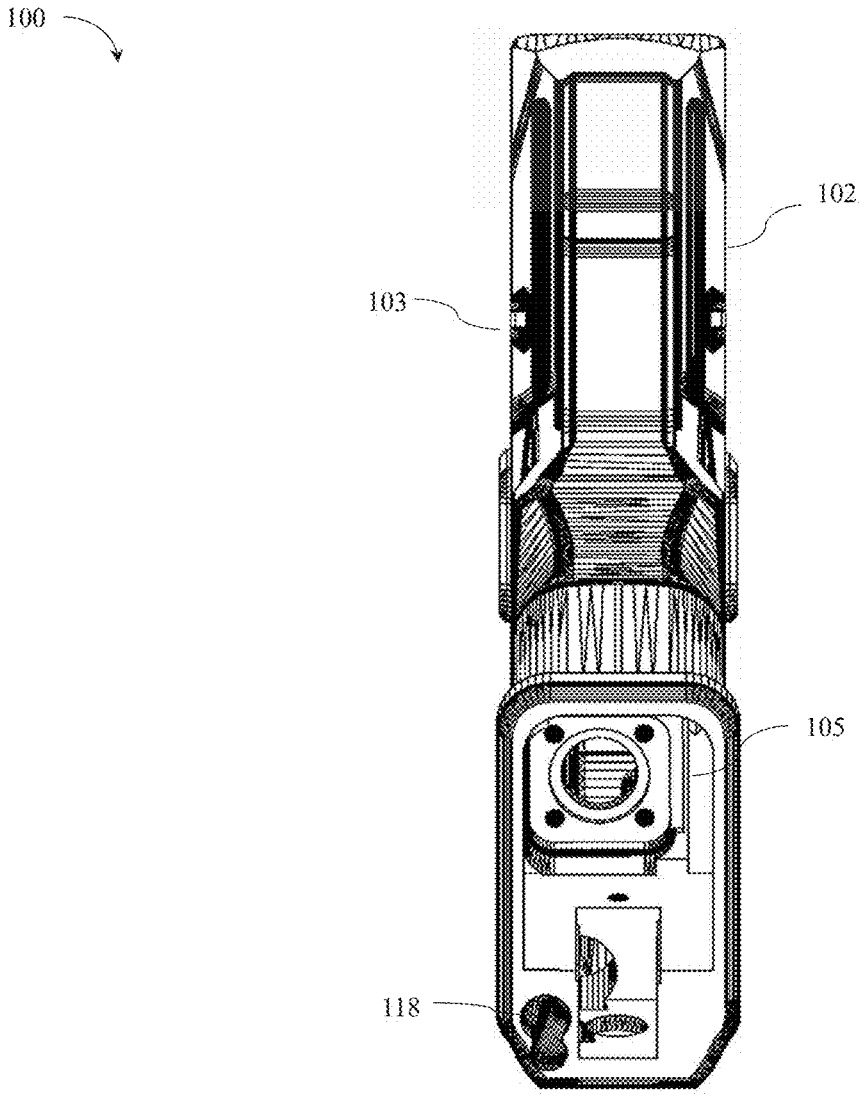
FIG. 6 depicts a bottom view of the grip and frame adapter for airsoft guns, according to the first embodiment.
Figure 7:
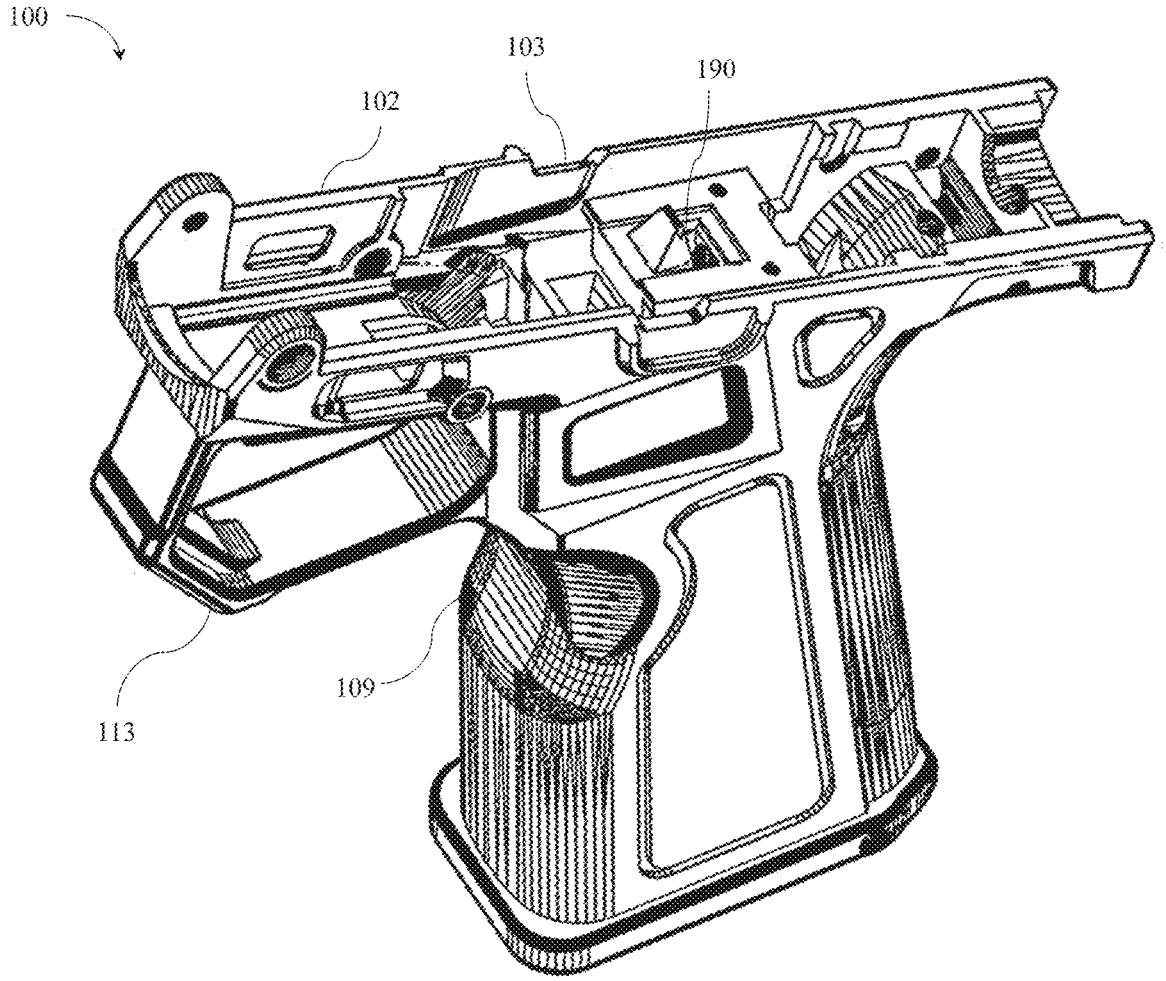
FIG. 7 depicts a top perspective view of the grip and frame adapter for airsoft guns, according to the first embodiment.
Figure 8:
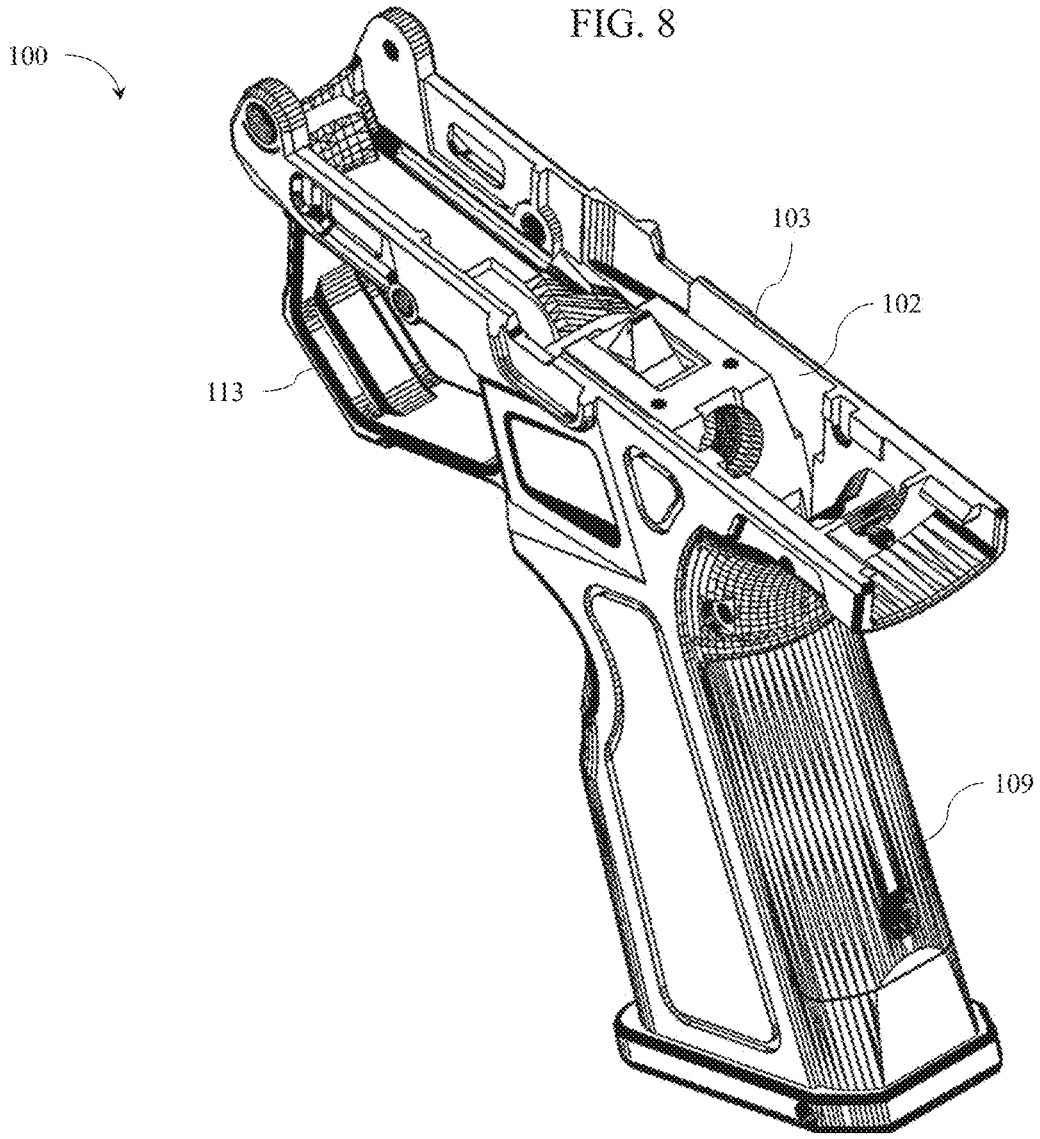
FIG. 8 depicts a rear perspective view of the grip and frame adapter for airsoft guns, according to the first embodiment.
Figure 9:
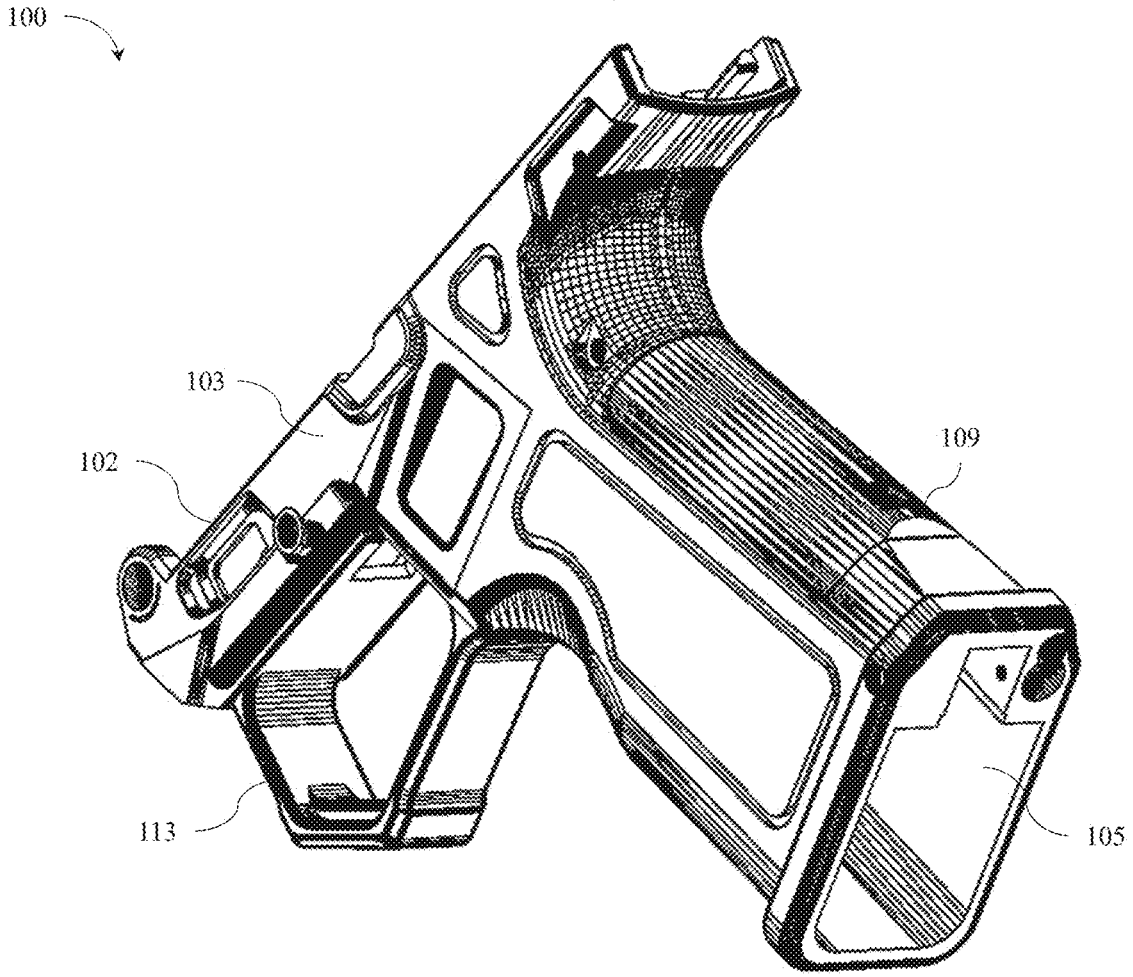
FIG. 9 depicts a bottom perspective view of the grip and frame adapter for airsoft guns, according to the first embodiment.
Figure 10:
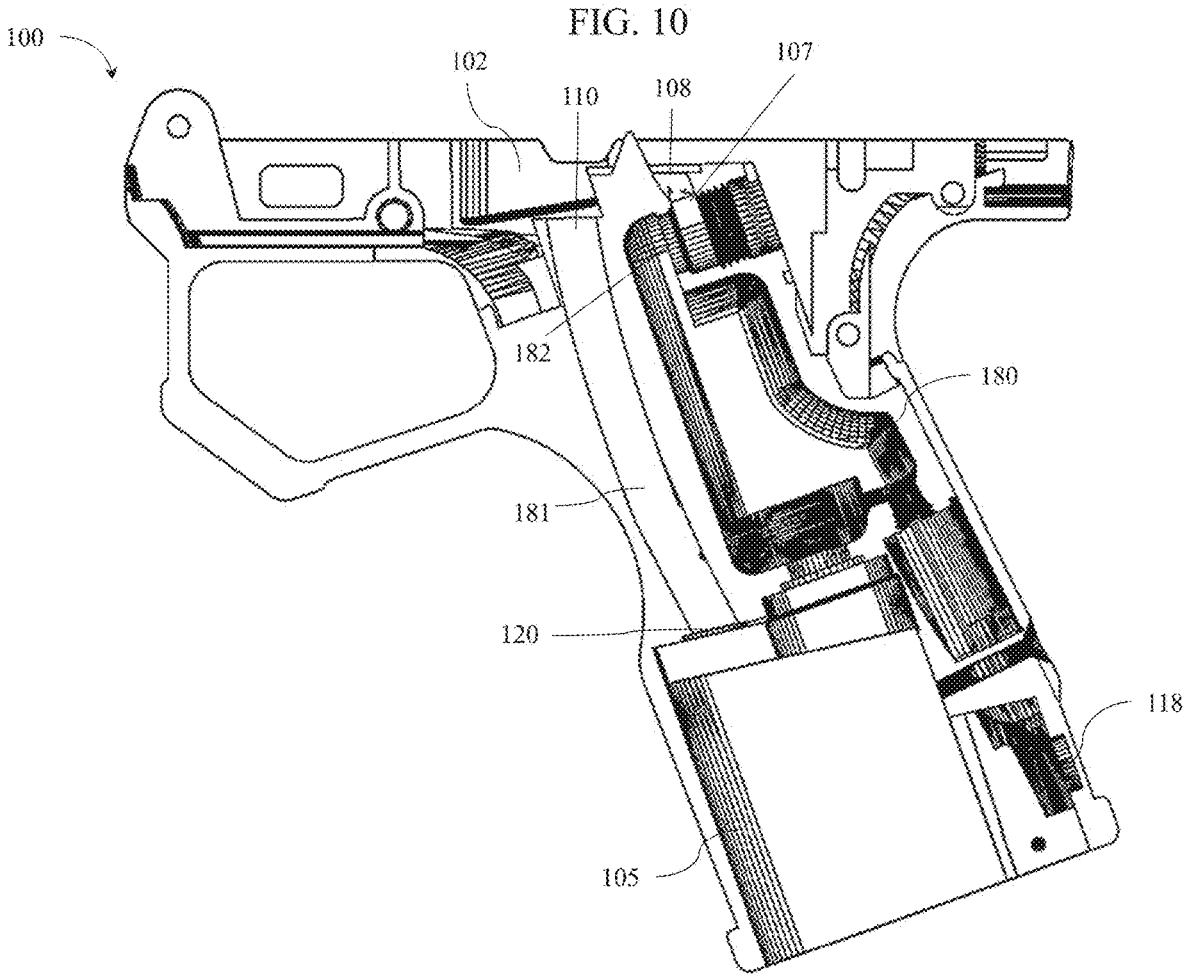
FIG. 10 depicts a cross-sectional view of the grip and frame adapter for airsoft guns, according to the first embodiment.
Figure 11:
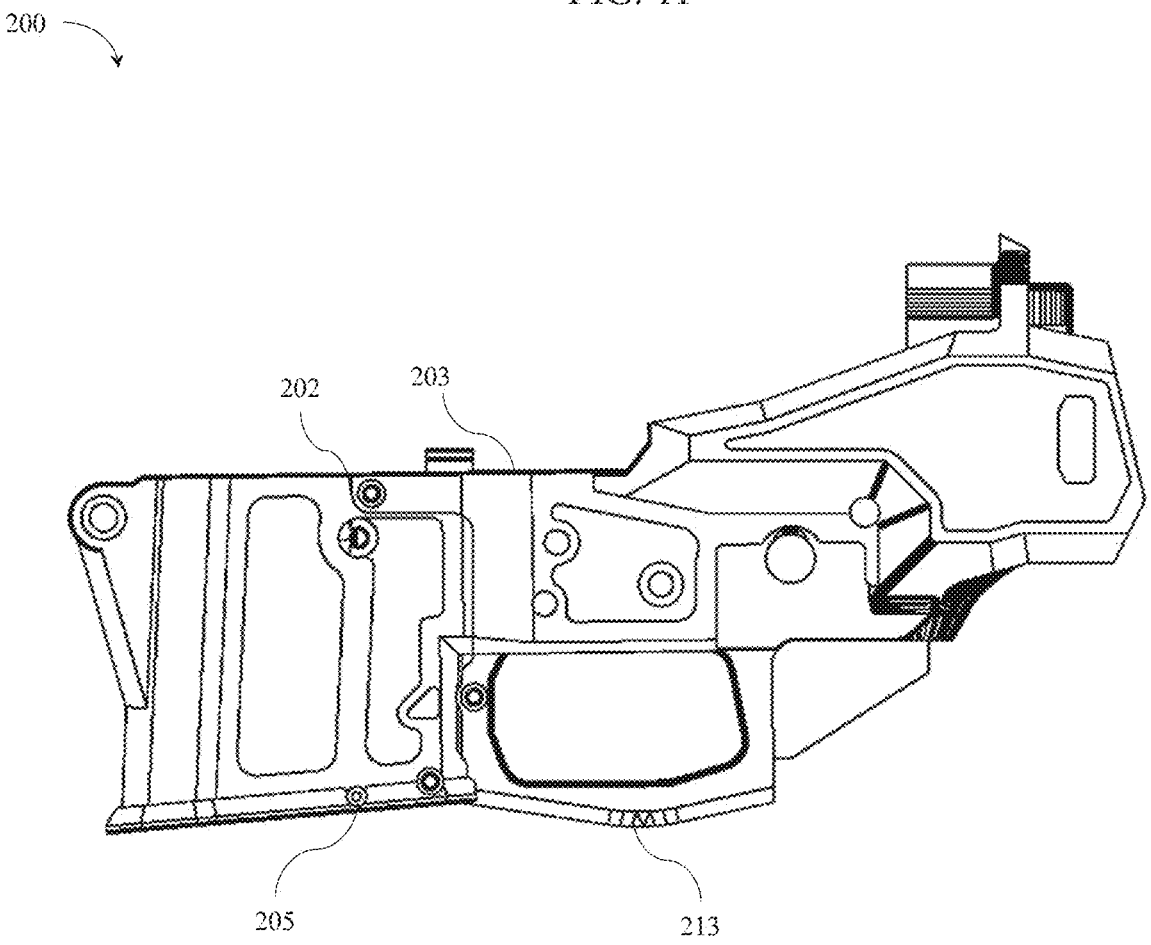
FIG. 11 depicts a right-side view of a grip and frame adapter for airsoft guns, according to a second embodiment.
Figure 12:
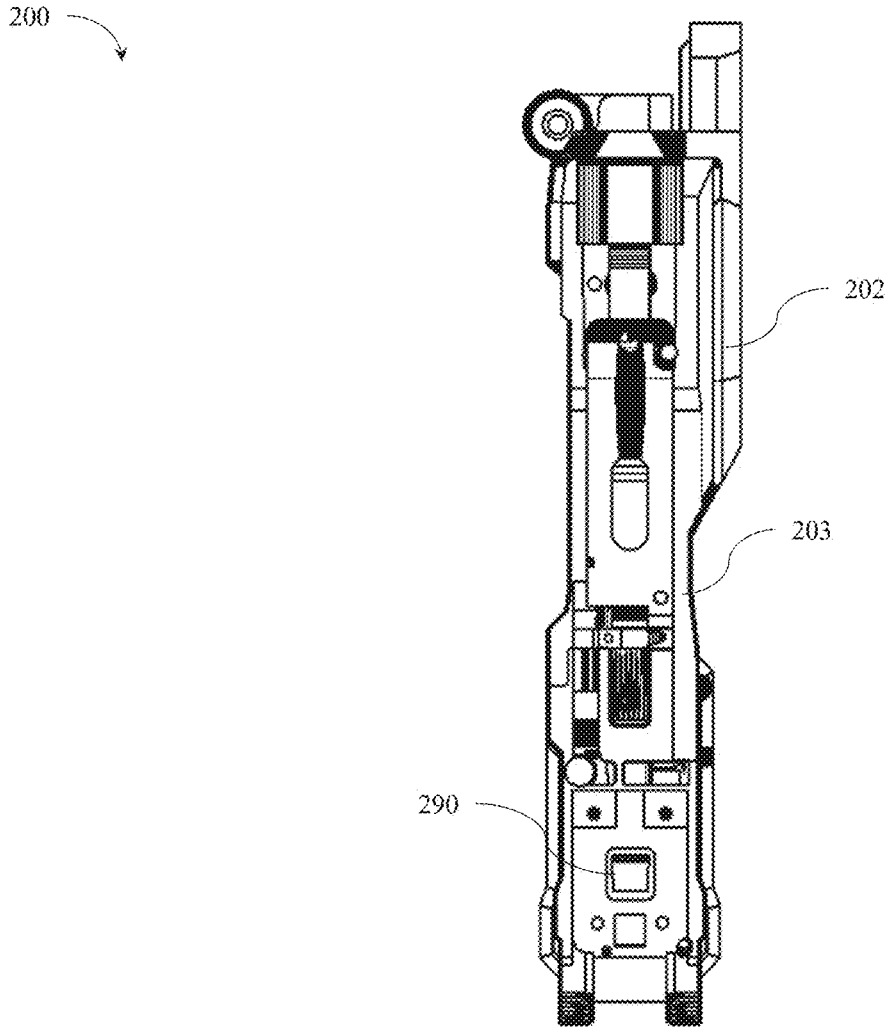
FIG. 12 depicts a top view of the grip and frame adapter for airsoft guns, according to the second embodiment.
Figure 13:
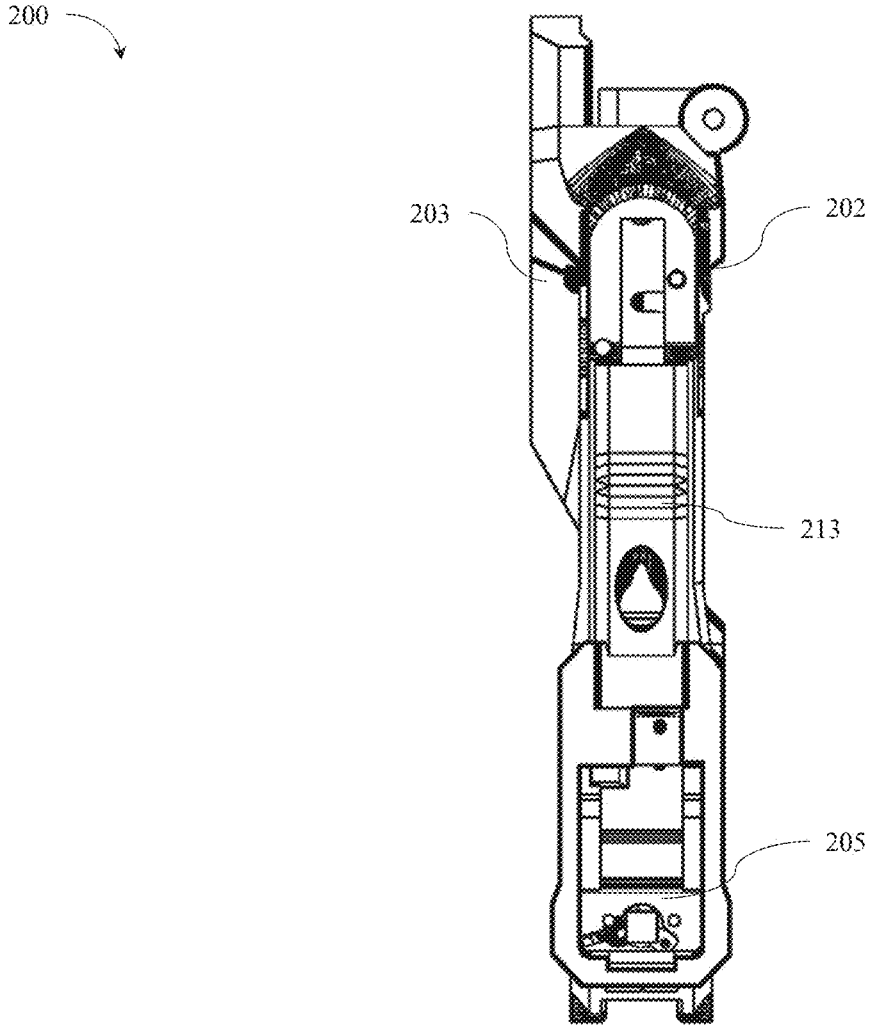
FIG. 13 depicts a bottom view of the grip and frame adapter for airsoft guns, according to the second embodiment.
Figure 14:
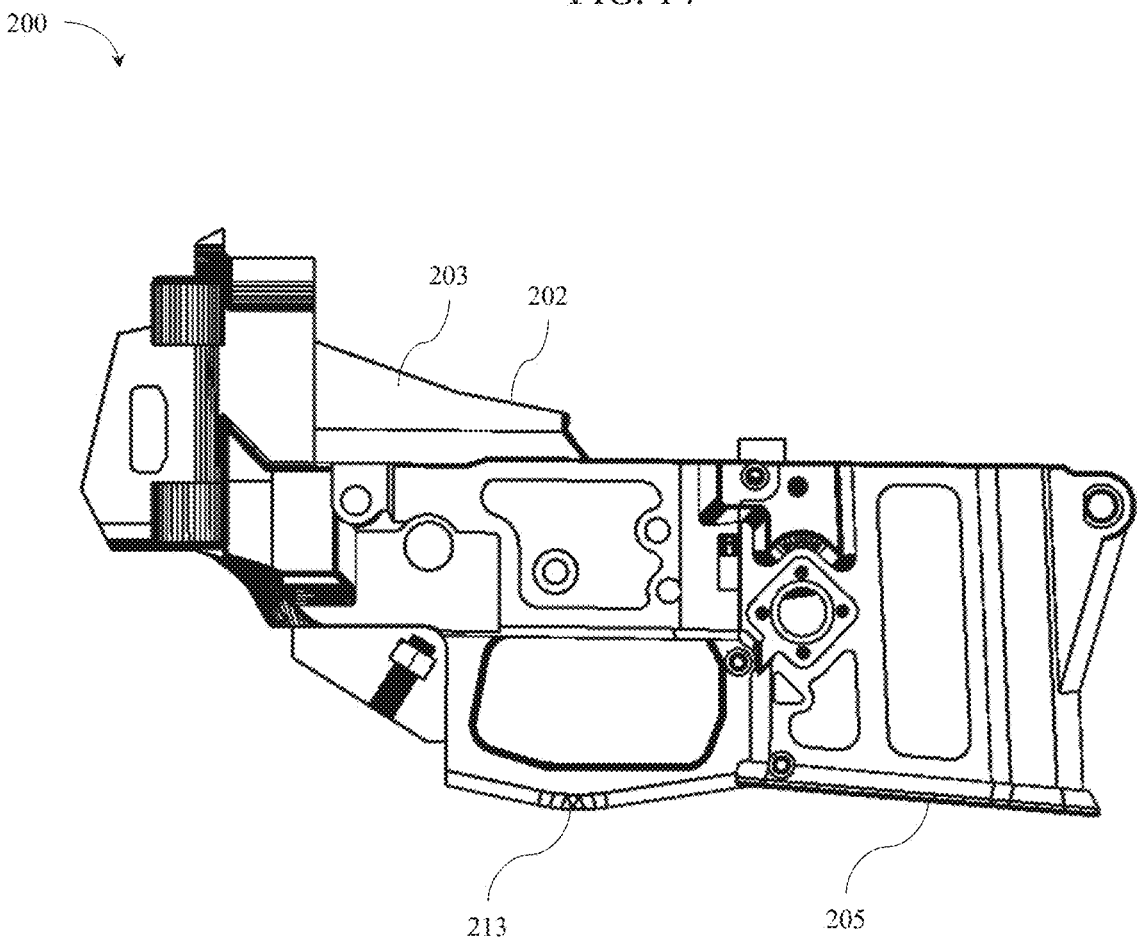
FIG. 14 depicts a left-side view of the grip and frame adapter for airsoft guns, according to the second embodiment.
Figure 15:
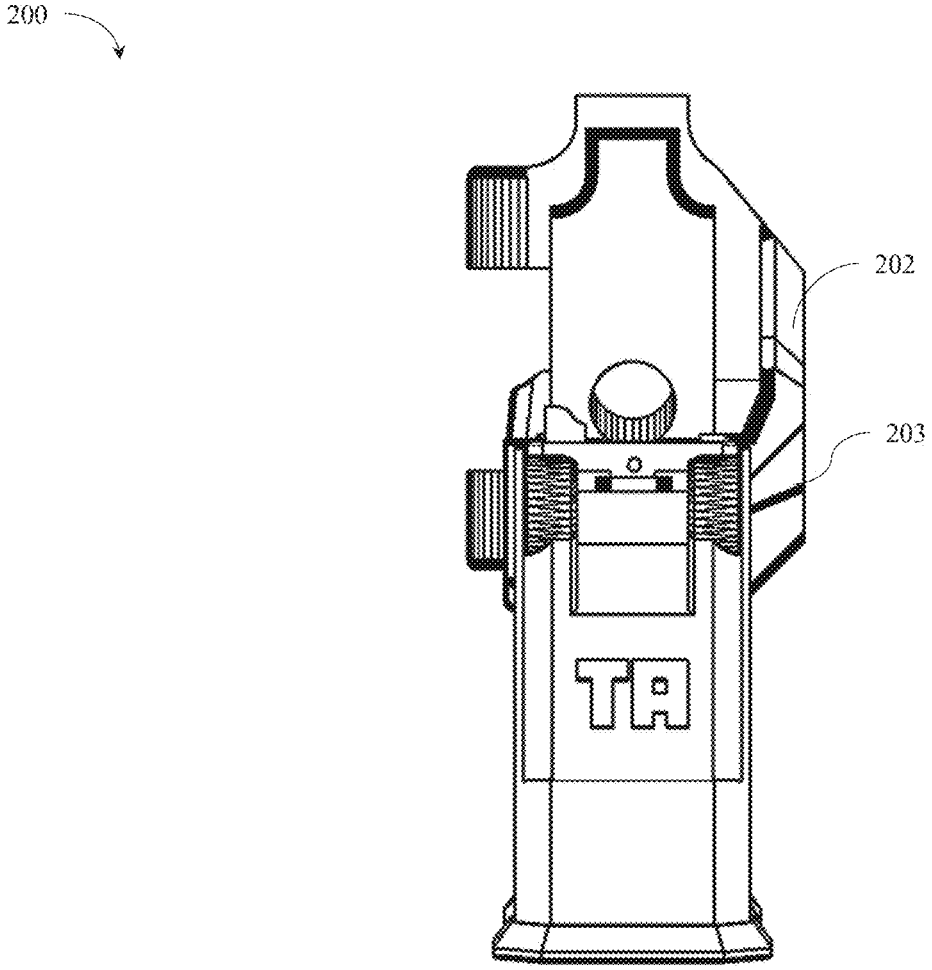
FIG. 15 depicts a front view of the grip and frame adapter for airsoft guns, according to the second embodiment.
Figure 16:
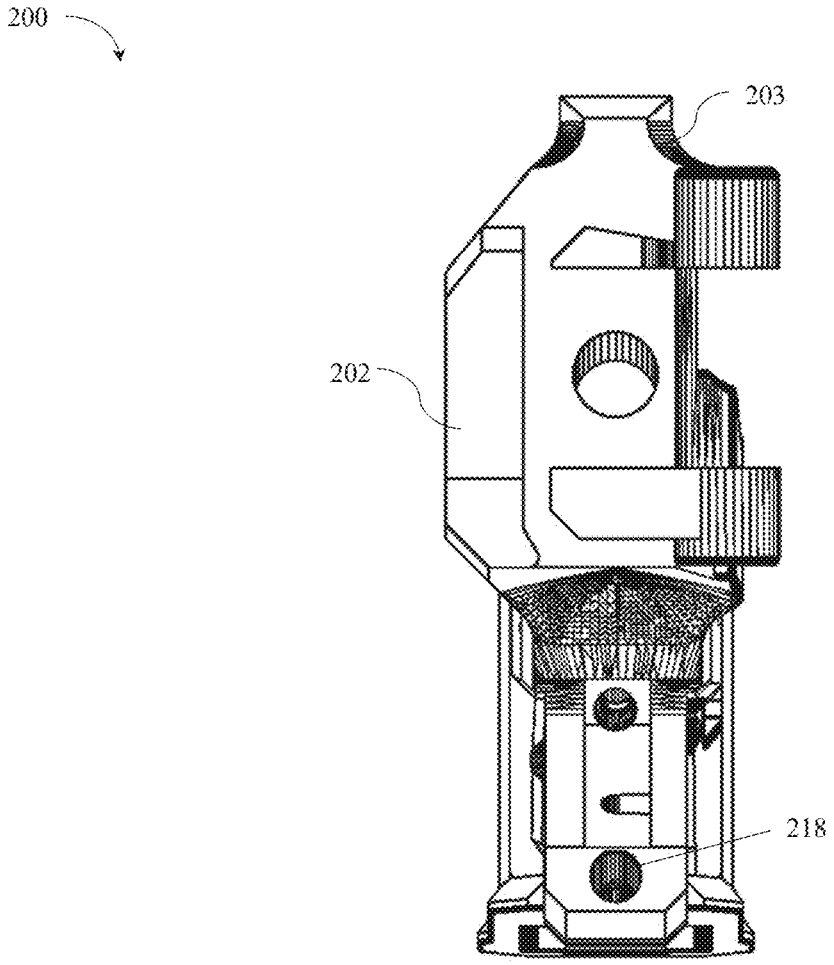
FIG. 16 depicts a rear view of the grip and frame adapter for airsoft guns, according to the second embodiment.
Figure 17:
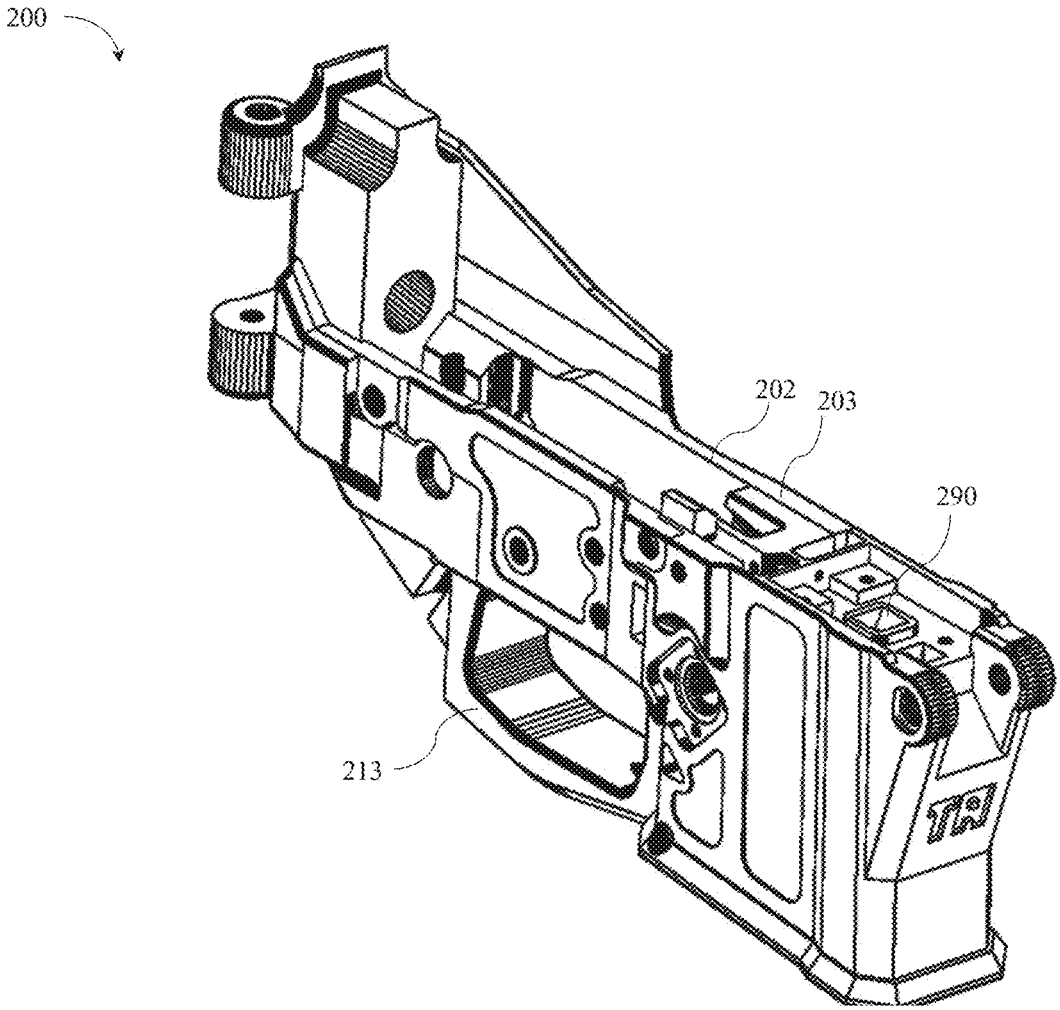
FIG. 17 depicts a top perspective view of the grip and frame adapter for airsoft guns, according to the second embodiment.
Figure 18:
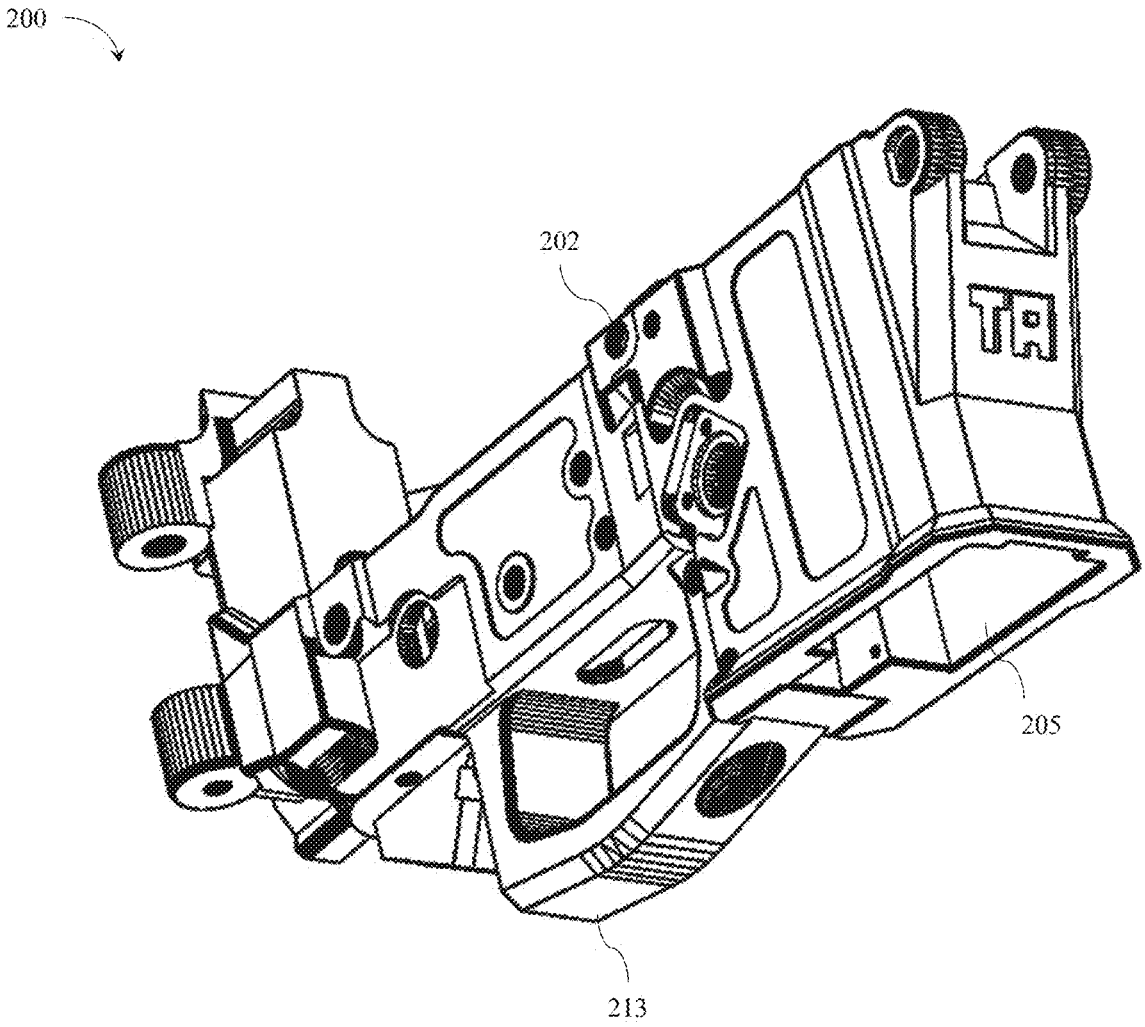
FIG. 18 depicts a bottom perspective view of the grip and frame adapter for airsoft guns, according to the second embodiment.
Figure 19:
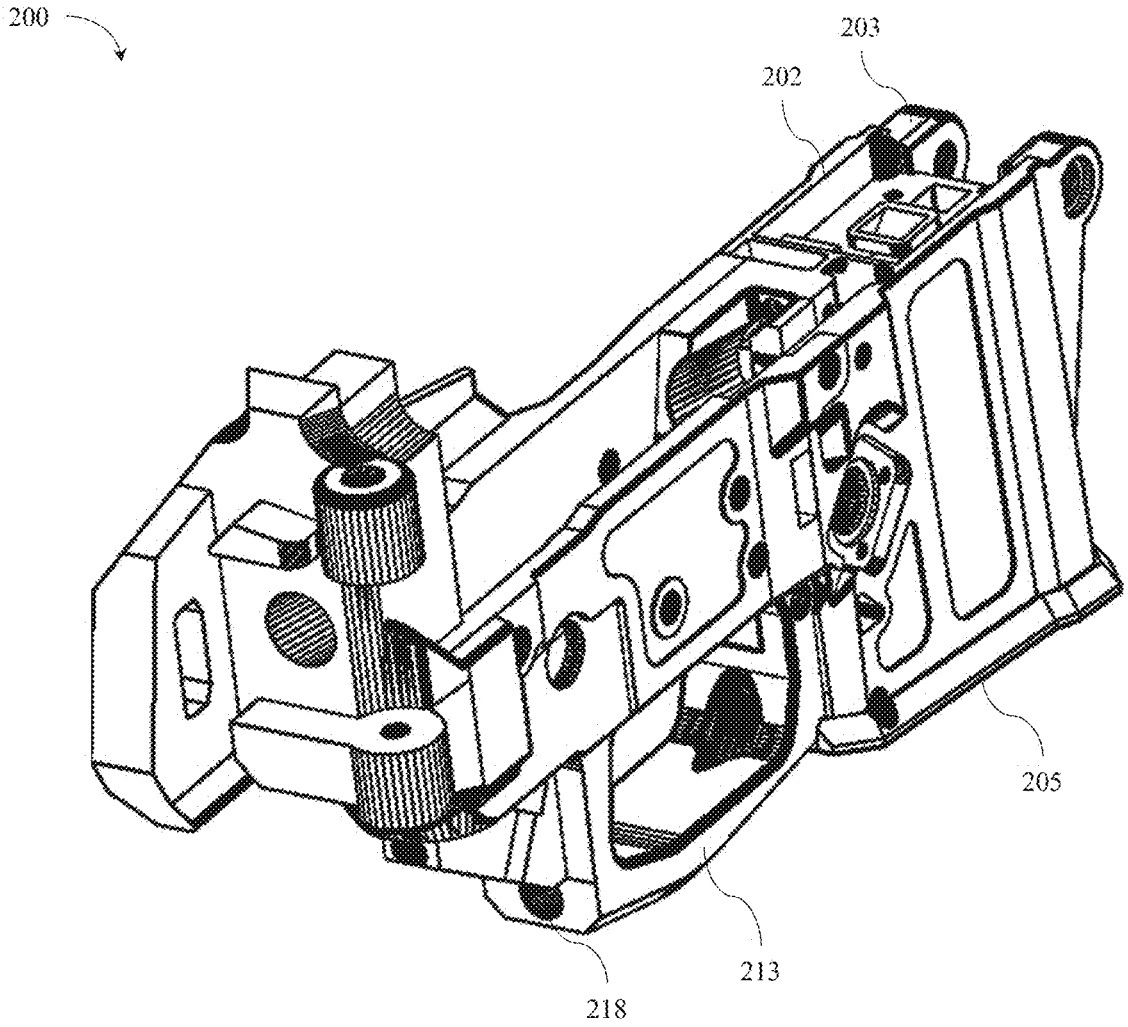
FIG. 19 depicts a front perspective view of the grip and frame adapter for airsoft guns, according to the second embodiment.
Figure 20:
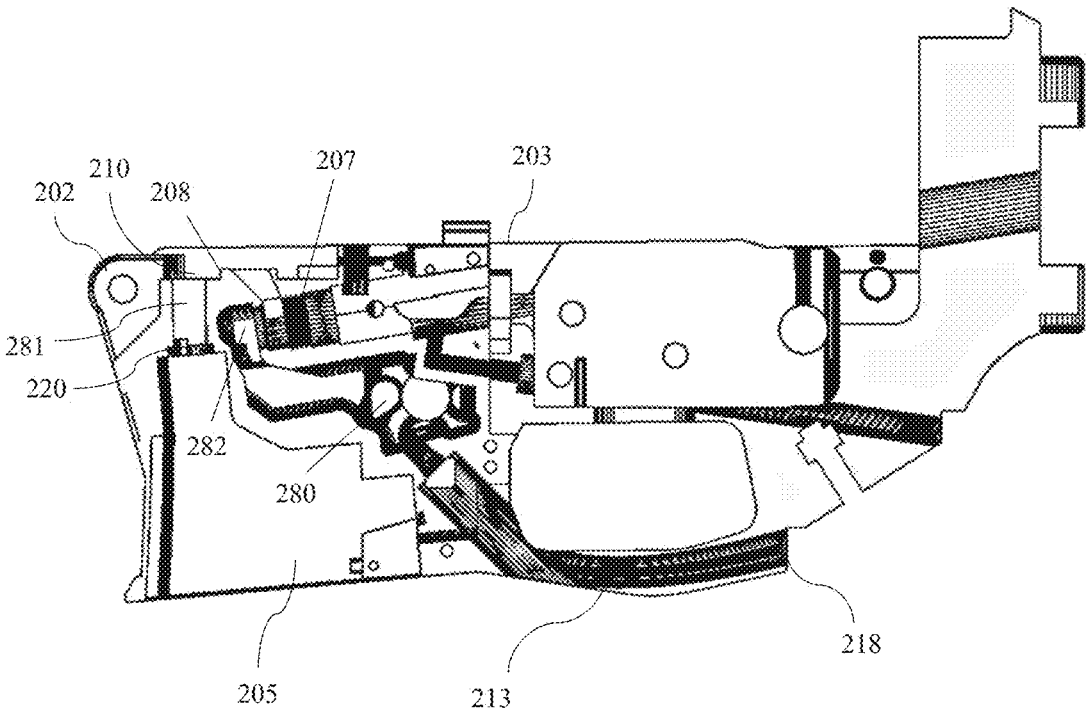
FIG. 20 depicts a cross-sectional view of the grip and frame adapter for airsoft guns, according to the second embodiment.
Figure 21:
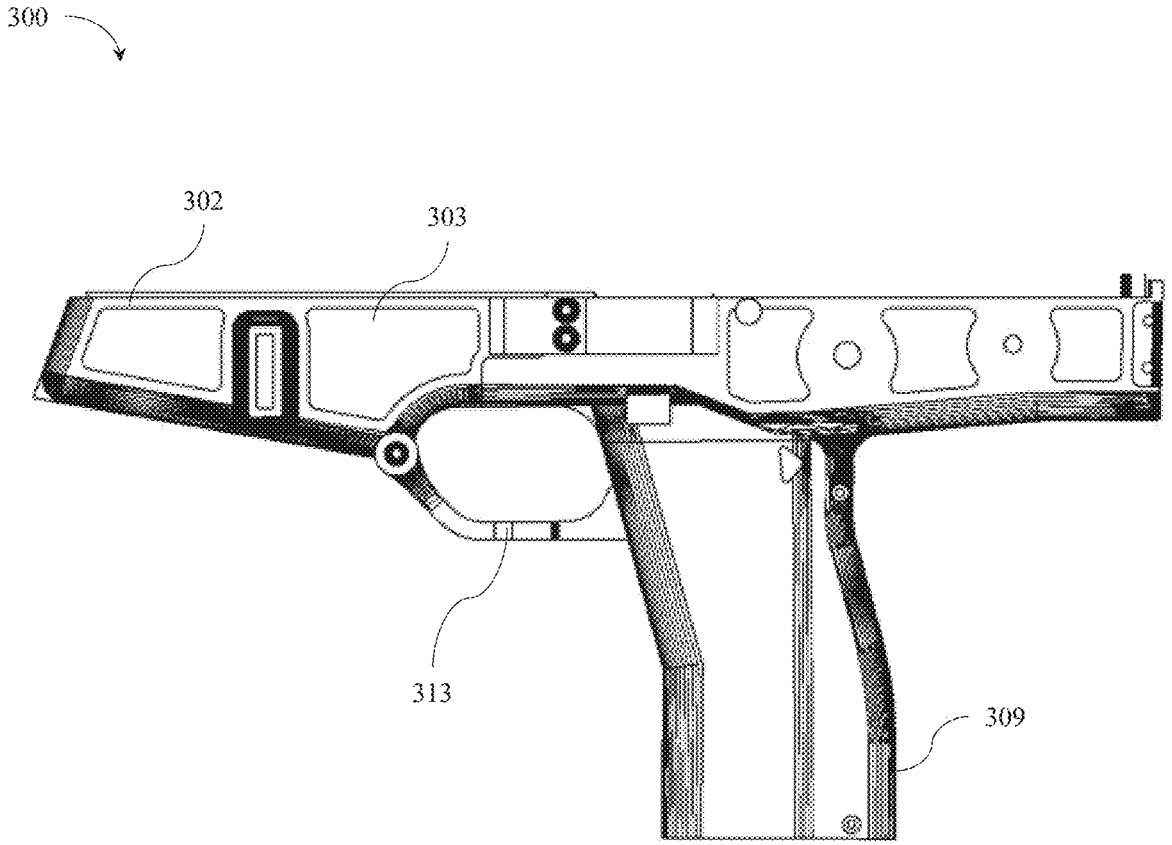
FIG. 21 depicts a left-side view of a grip and frame adapter for airsoft guns, according to a third embodiment.
Figure 22:
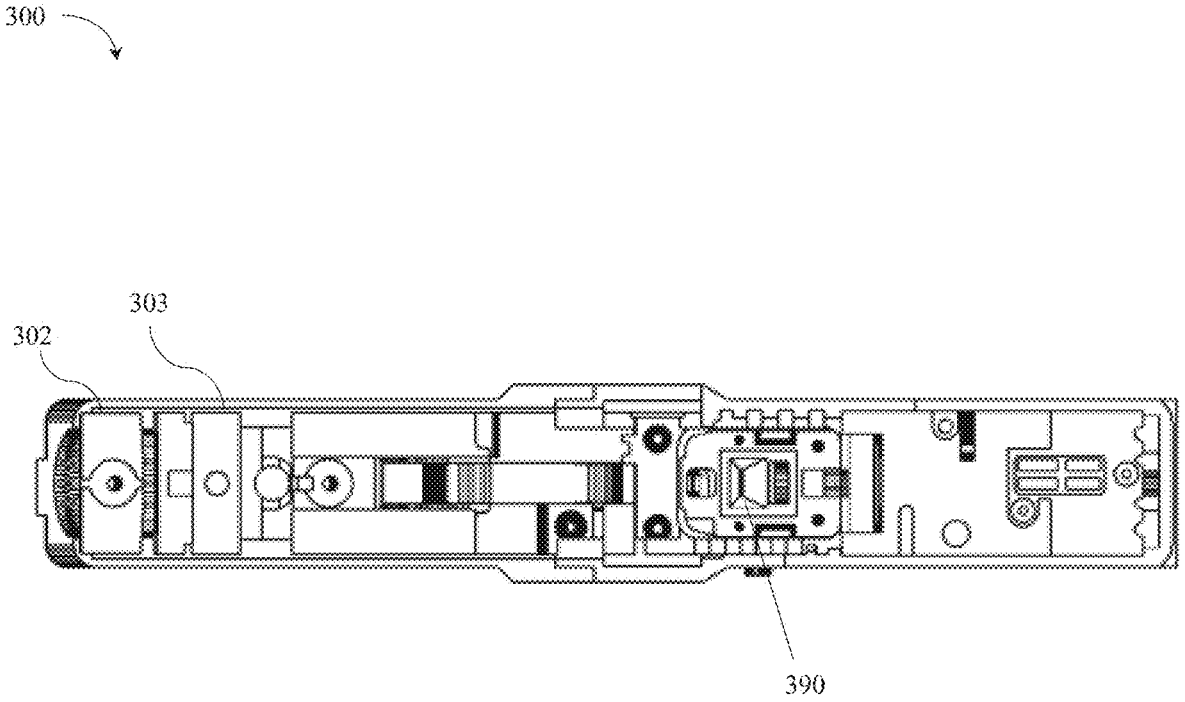
FIG. 22 depicts a top view of the grip and frame adapter for airsoft guns, according to the third embodiment.
Figure 23:
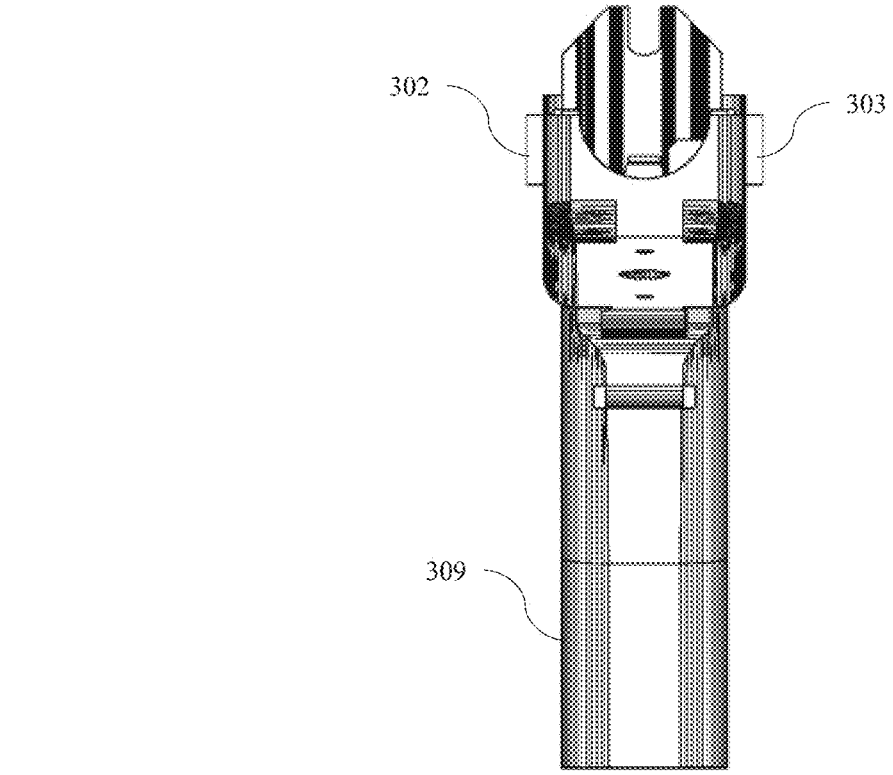
FIG. 23 depicts a front view of the grip and frame adapter for airsoft guns, according to the third embodiment.
Figure 24:
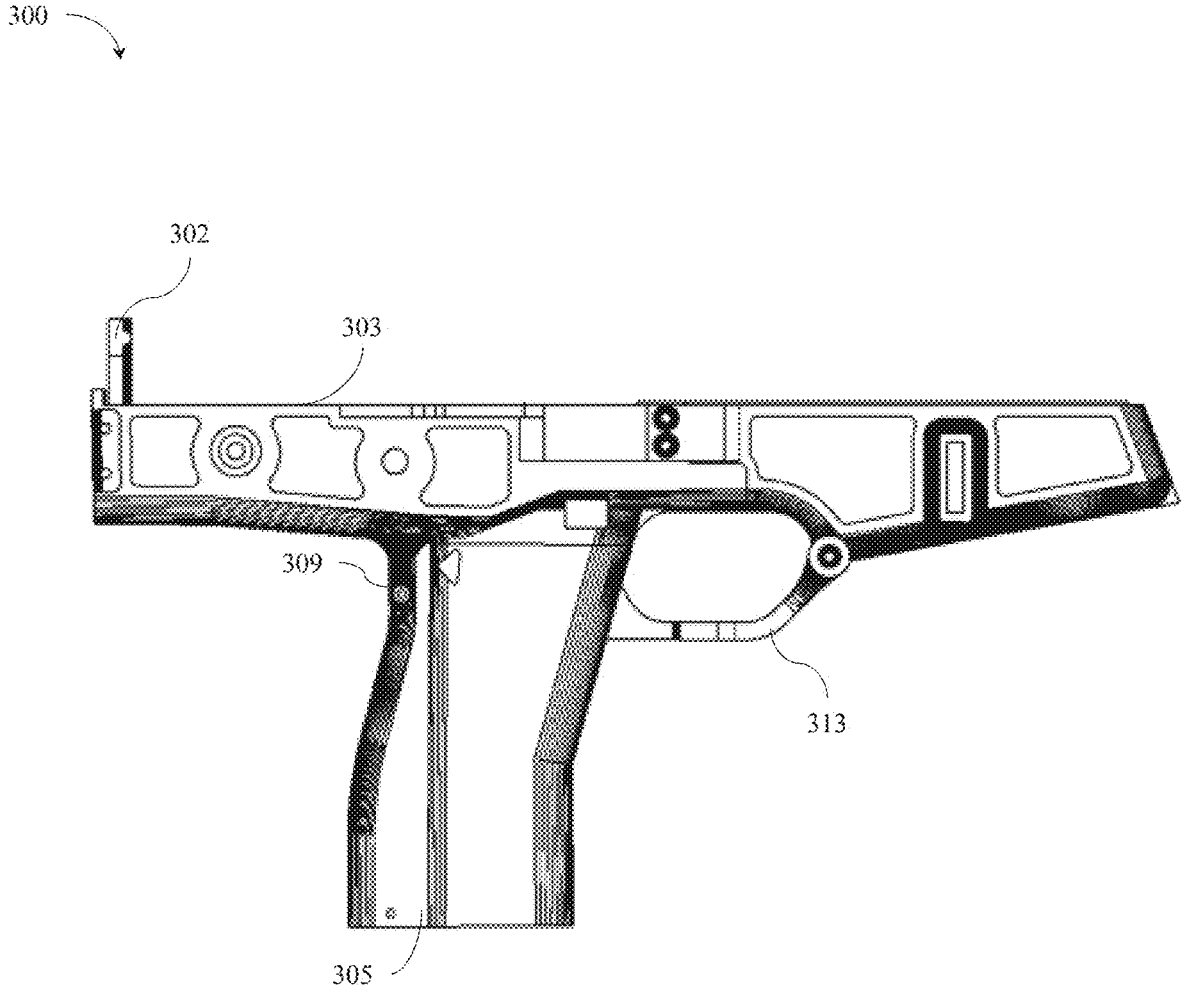
FIG. 24 depicts a right-side view of the grip and frame adapter for airsoft guns, according to the third embodiment.
Figure 25:
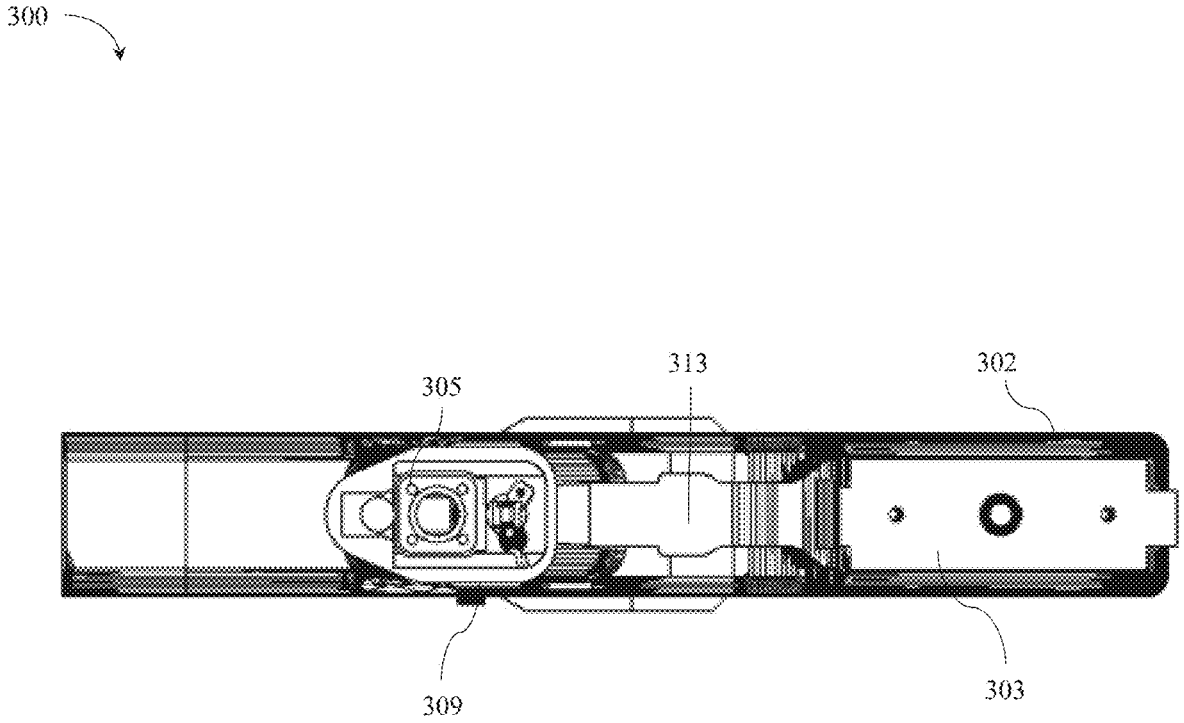
FIG. 25 depicts a bottom view of the grip and frame adapter for airsoft guns, according to the third embodiment.
Figure 26:
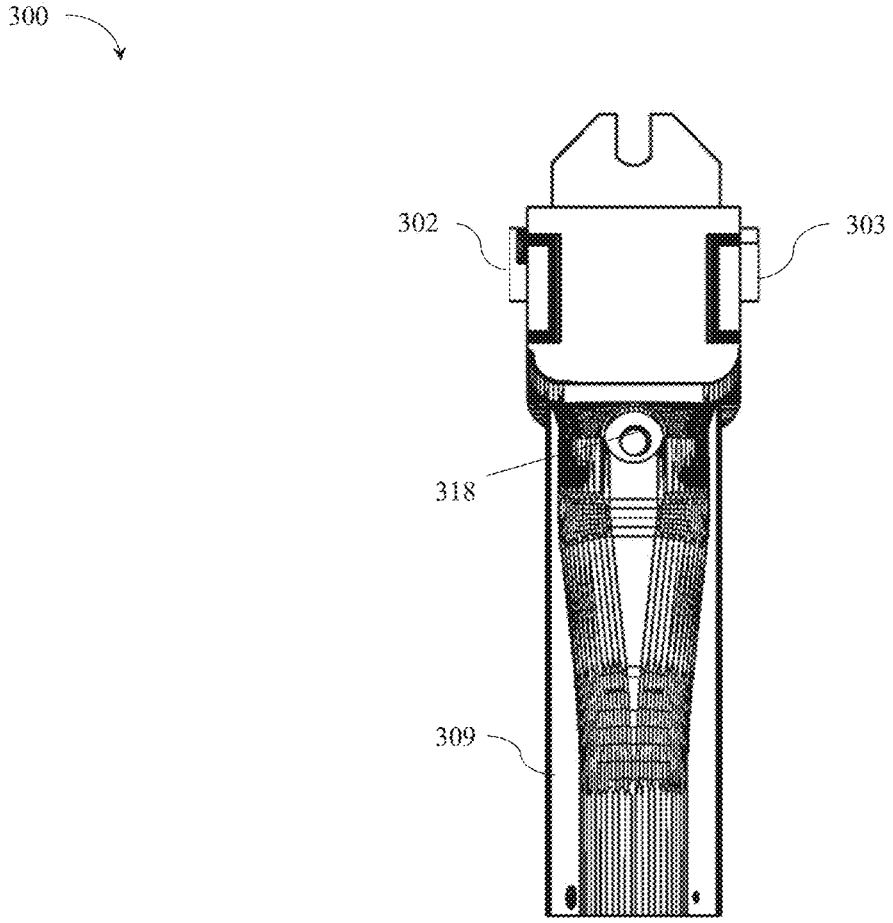
FIG. 26 depicts a rear view of the grip and frame adapter for airsoft guns, according to the third embodiment.
Figure 27:
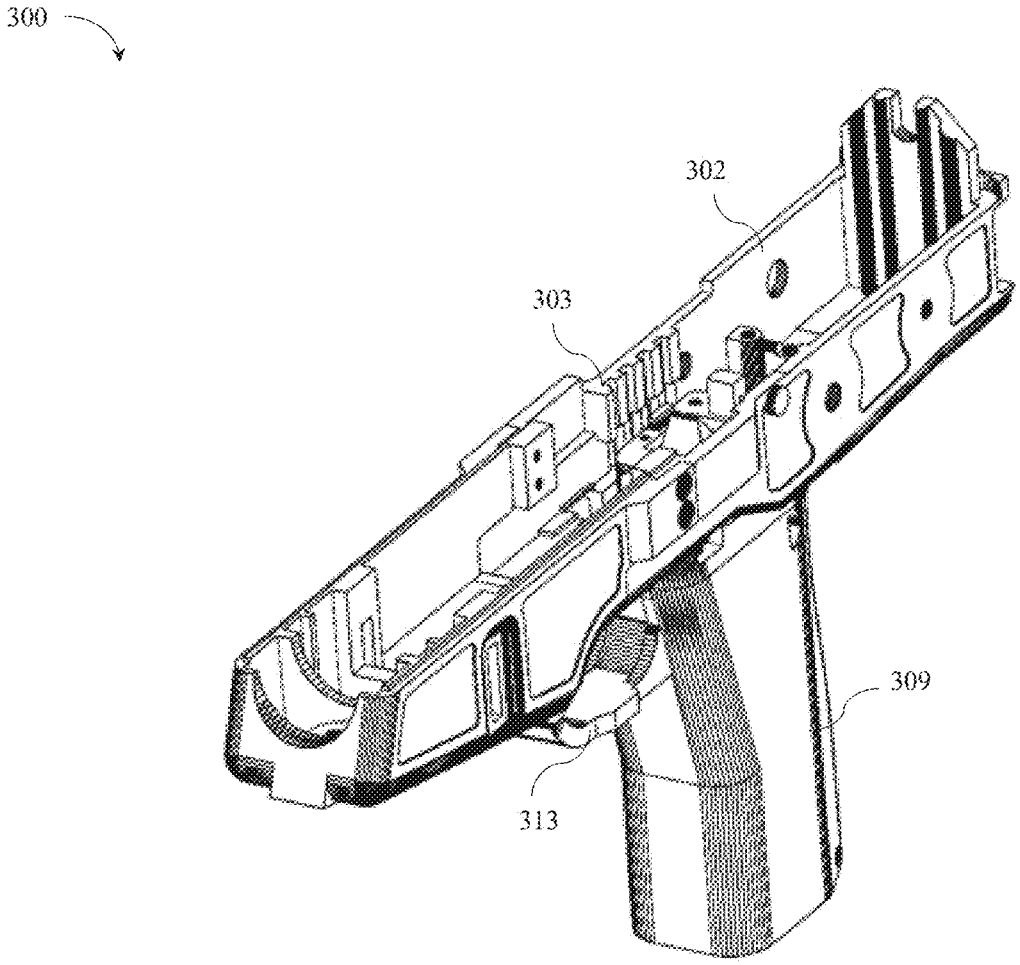
FIG. 27 depicts a top perspective view of the grip and frame adapter for airsoft guns, according to the third embodiment.
Figure 28:
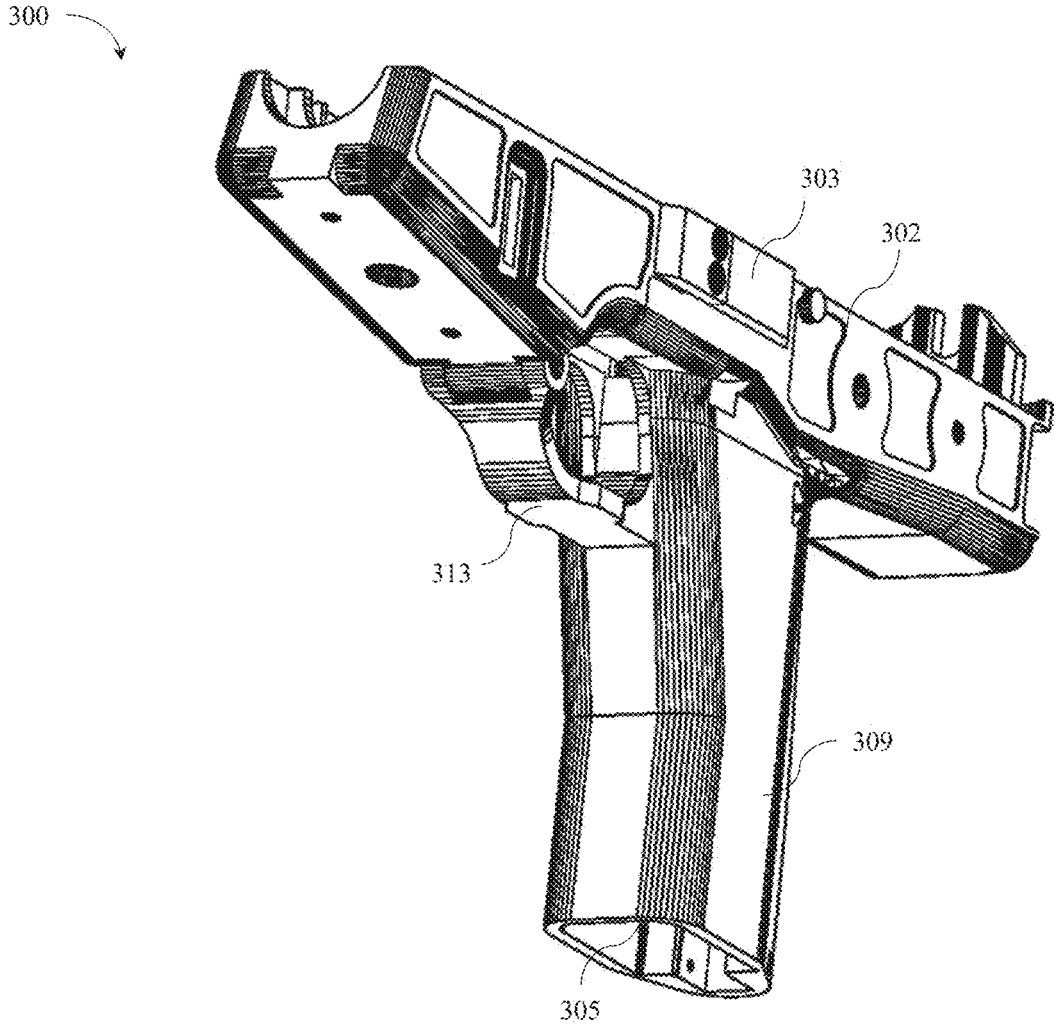
FIG. 28 depicts a bottom perspective view of the grip and frame adapter for airsoft guns, according to the third embodiment.
Figure 29:
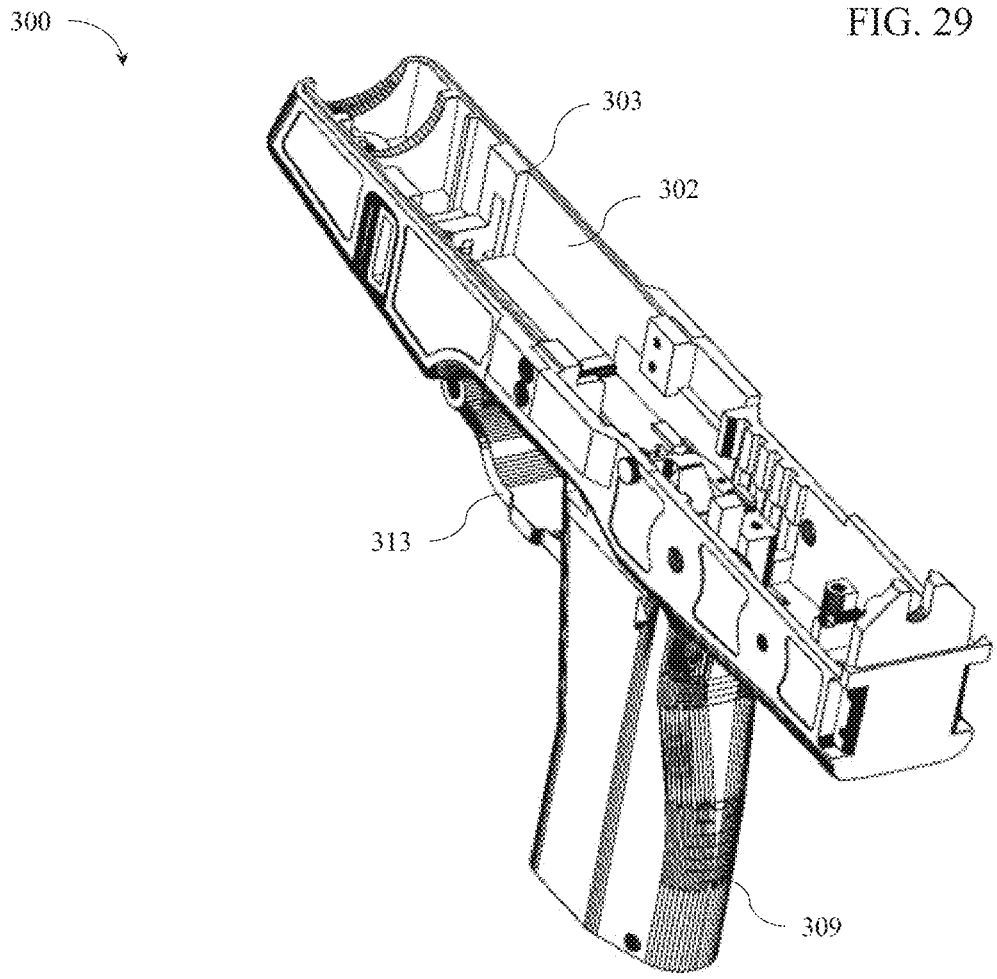
FIG. 29 depicts a rear perspective view of the grip and frame adapter for airsoft guns, according to the third embodiment.
Figure 30:
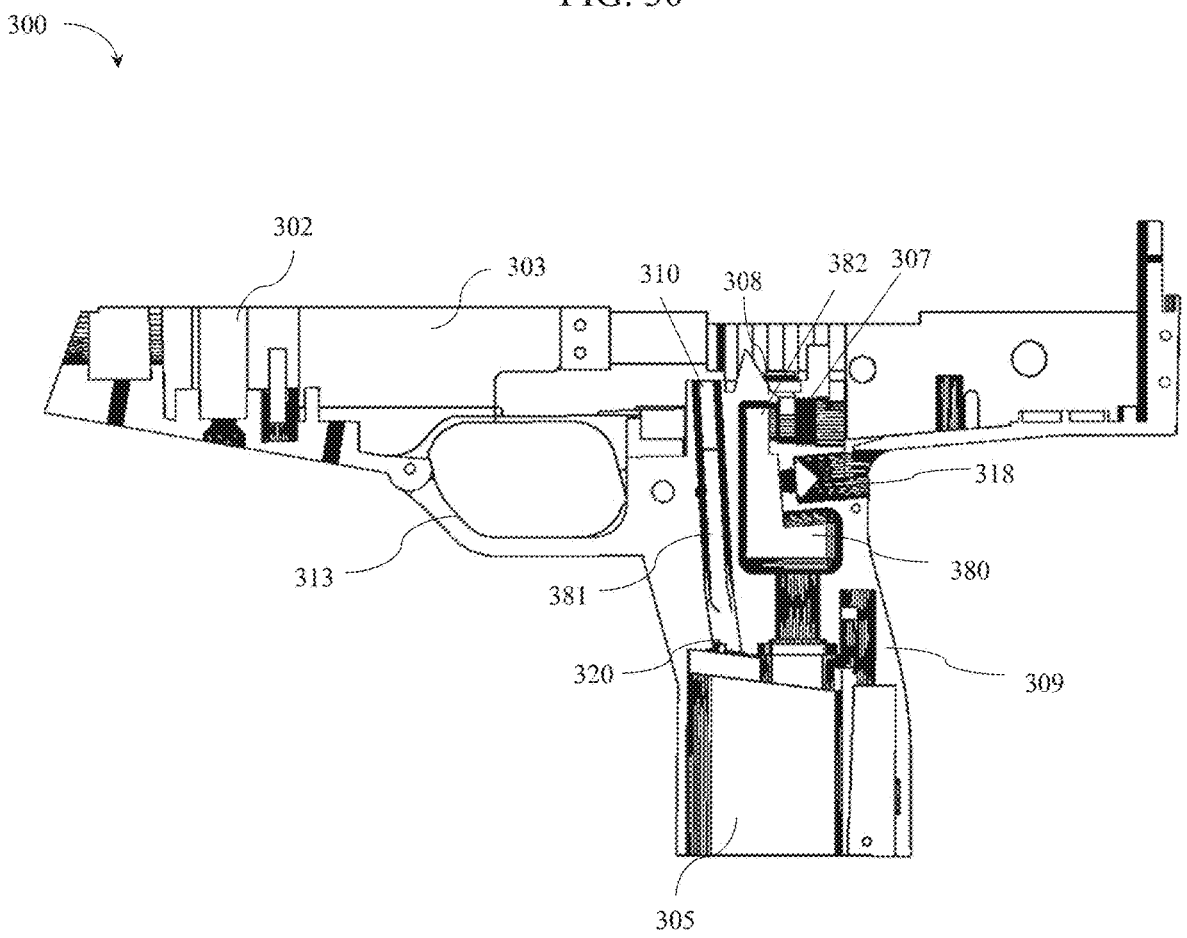
FIG. 30 depicts a cross-sectional view of the grip and frame adapter for airsoft guns, according to the third embodiment.
Figure 31:
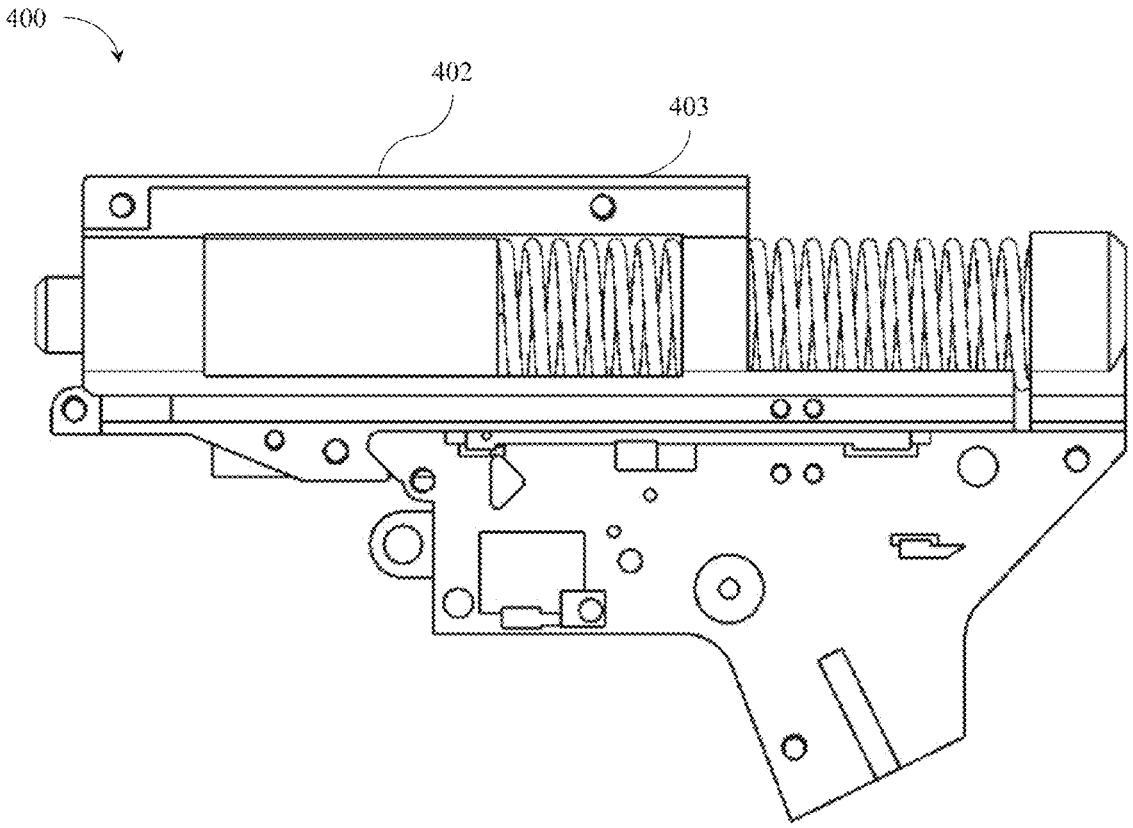
FIG. 31 depicts a left-side view of a grip and frame adapter for airsoft guns, according to a fourth embodiment.
Figure 32:
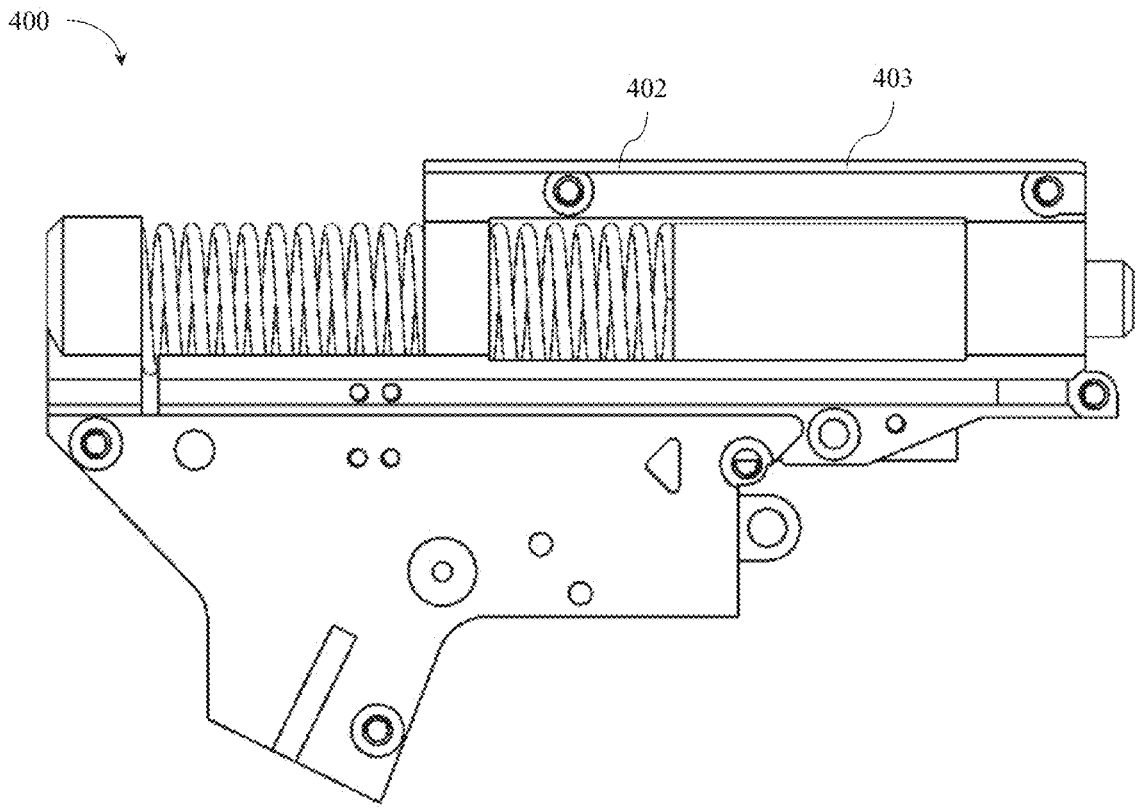
FIG. 32 depicts a right-side view of the grip and frame adapter for airsoft guns, according to the fourth embodiment.
Figure 33:
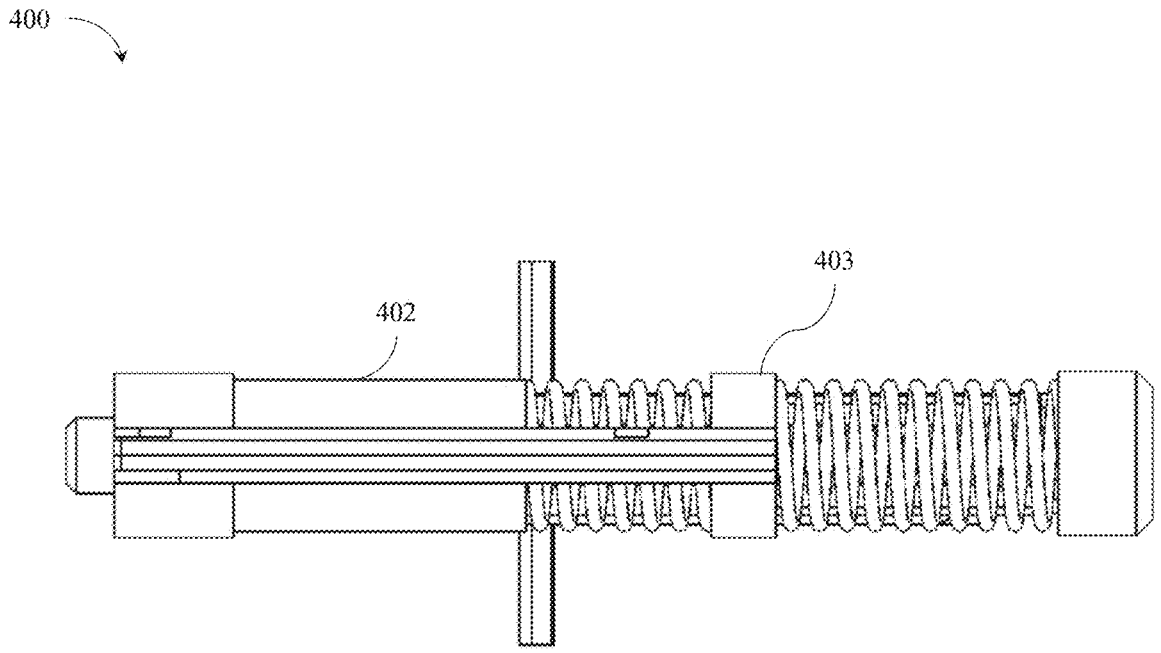
FIG. 33 depicts a top view of the grip and frame adapter for airsoft guns, according to the fourth embodiment.
Figure 34:
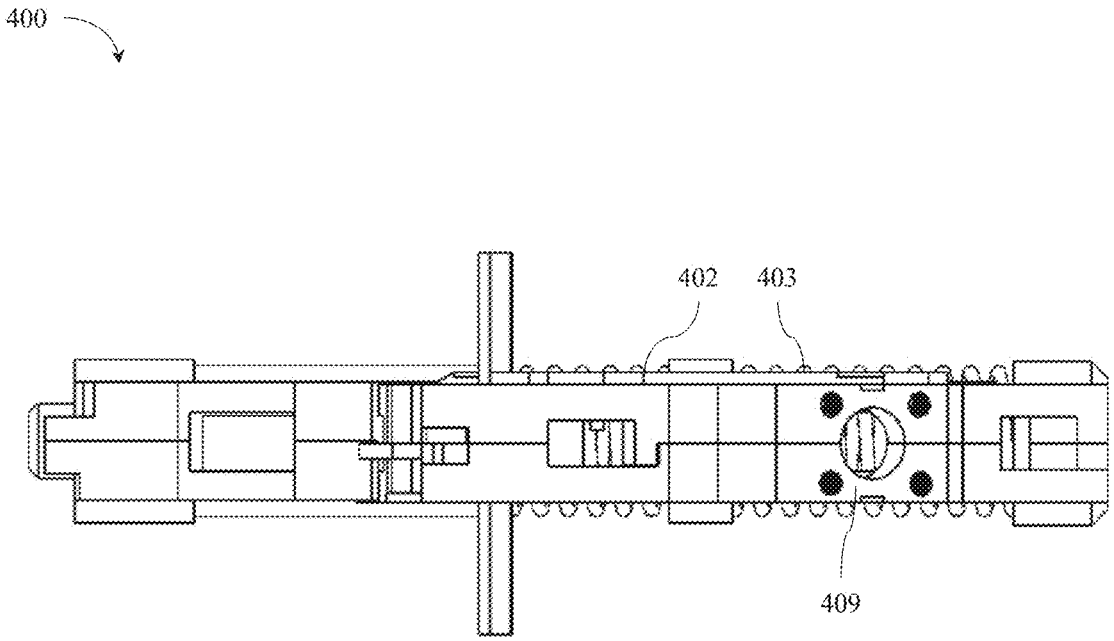
FIG. 34 depicts a bottom view of the grip and frame adapter for airsoft guns, according to the fourth embodiment.
Figure 35:
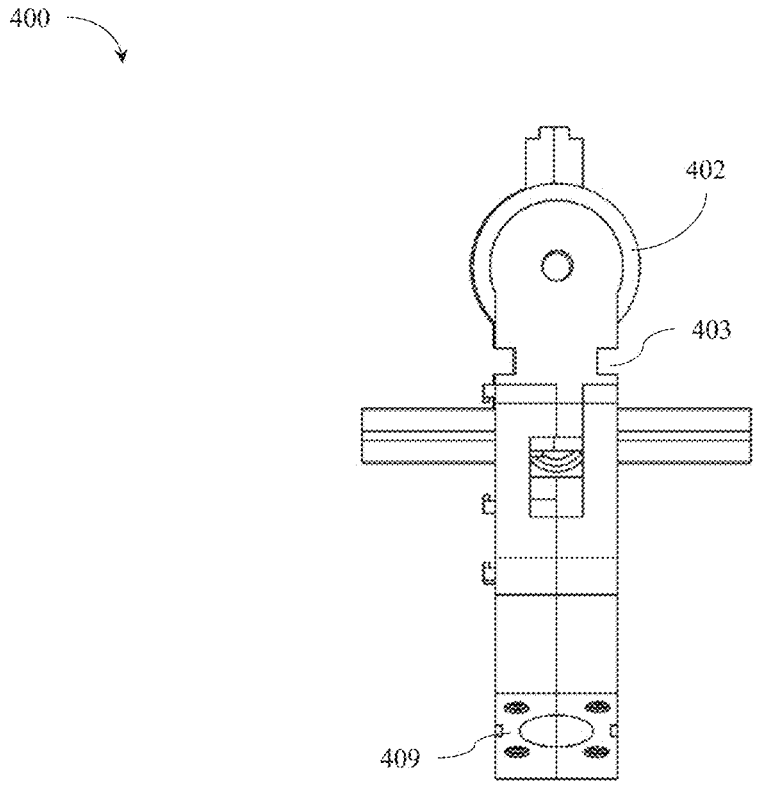
FIG. 35 depicts a rear view of the grip and frame adapter for airsoft guns, according to the fourth embodiment.
Figure 36:
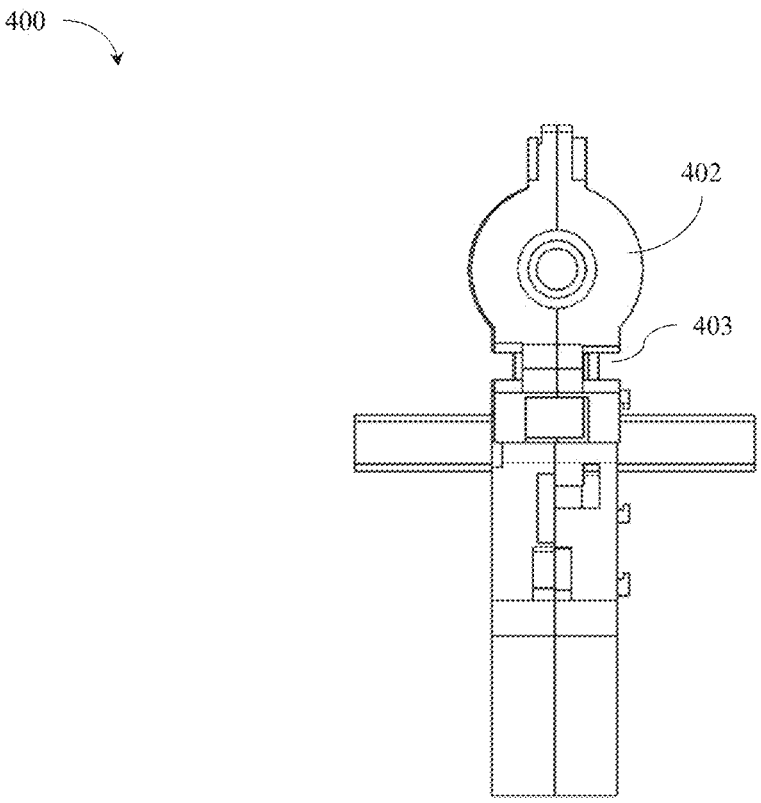
FIG. 36 depicts a front view of the grip and frame adapter for airsoft guns, according to the fourth embodiment.
Figure 37:
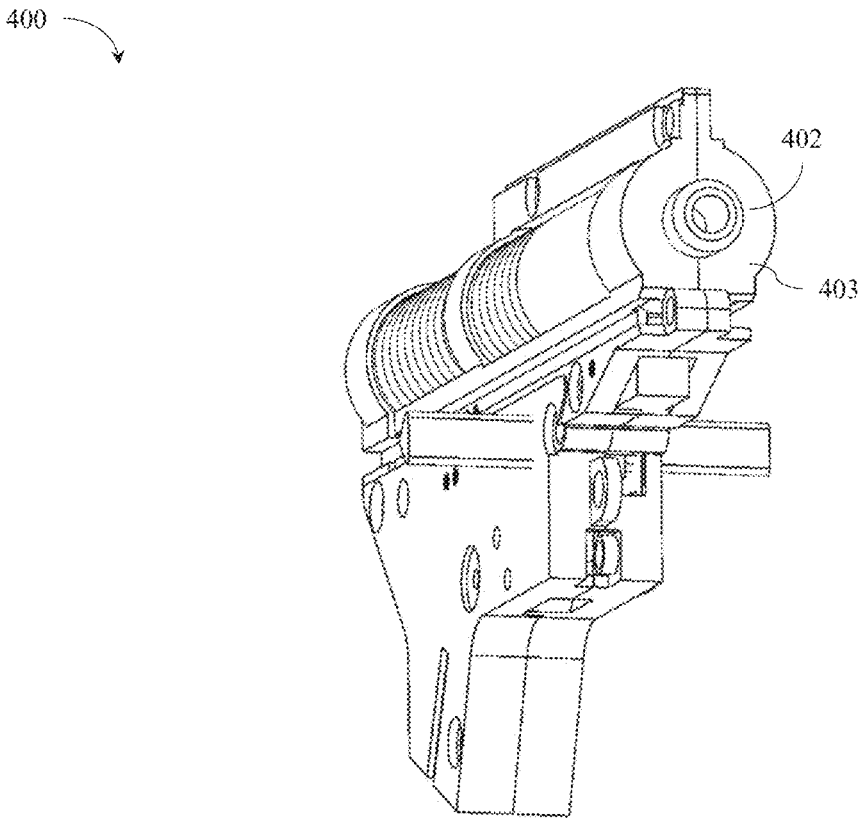
FIG. 37 depicts a front perspective view of the grip and frame adapter for airsoft guns, according to the fourth embodiment.
Figure 38:
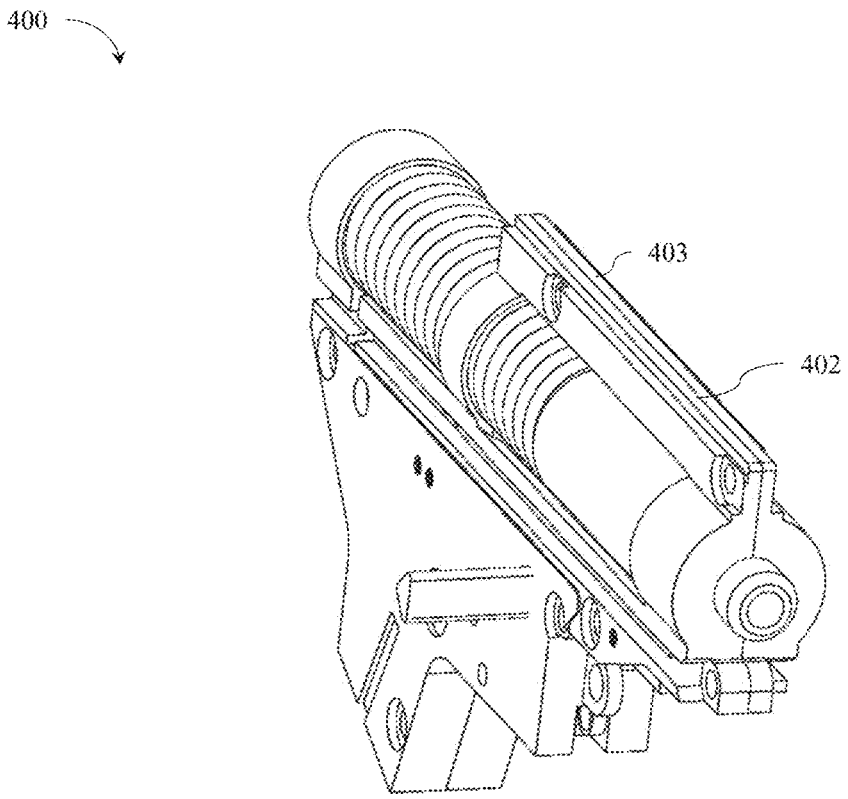
FIG. 38 depicts a top perspective view of the grip and frame adapter for airsoft guns, according to the fourth embodiment.
Figure 39:
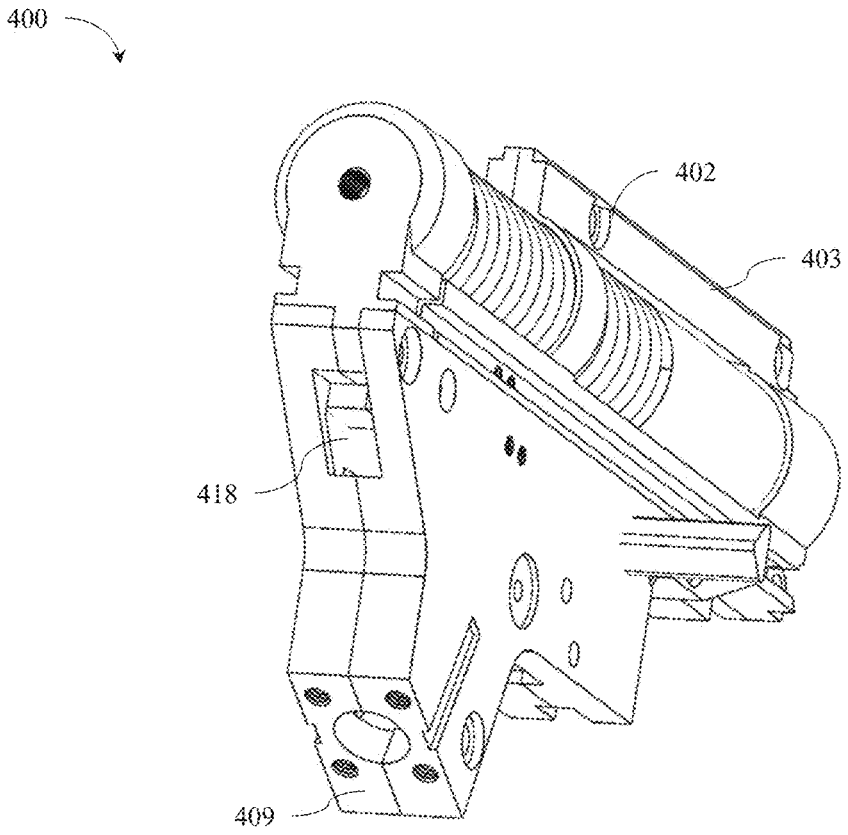
FIG. 39 depicts a bottom perspective view of the grip and frame adapter for airsoft guns, according to the fourth embodiment.
Figure 40:
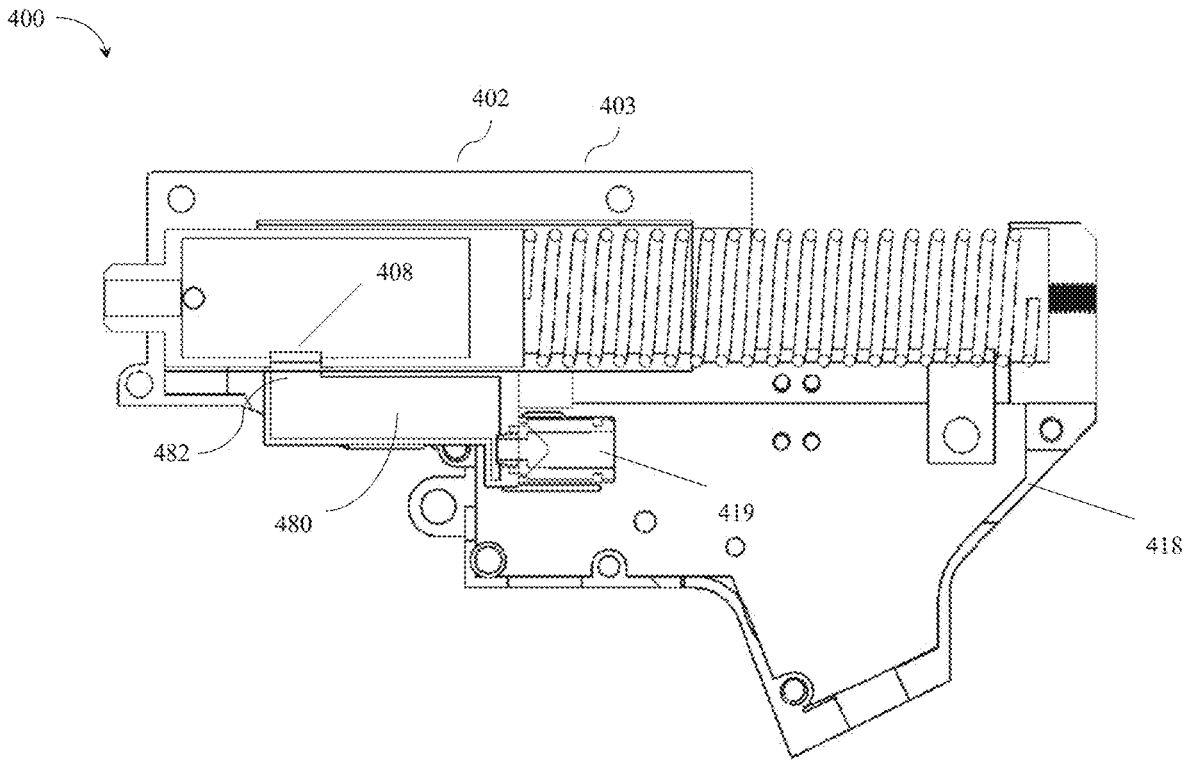
FIG. 40 depicts a cross-sectional view of the grip and frame adapter for airsoft guns, according to the fourth embodiment.

The accompanying drawings, which are incorporated in and constitute a part of this disclosure, illustrate various example embodiments. The claimed grip and frame adapter for airsoft guns will now be described with respect to FIGS. 1-40.

The grip and frame airsoft gun adapter 100 features a housing 102 made from a single, integrally formed plastic element, which, in one embedment, may be 3D printed using a 3D printer. The housing serves as the primary structural component of the airsoft gun adapter 100. The housing is designed to accommodate all the other internal components, offering a unified body for the entire mechanism.

The housing defines a frame 103 configured to house operating parts of the airsoft gun, such as a hammer, a firing mechanism, a trigger, a barrel, and/or a piston valve a frame 103. The further includes a magazine well 105, a grip 109 and a trigger guard 113. The magazine well may be specifically shaped and sized to allow for a friction fit with the projectile magazine of the airsoft gun. The projectiles may be plastic BBs, metal BBs, gel balls, etc.

Within the housing is an air reservoir 180 specifically purposed for storing pressurized gas. The air reservoir is enclosed within this housing, storing the pressurized gas necessary to propel the projectiles. The air reservoir is configured to withstand gas pressures of between 100-130 psi or 120-150 psi. Near the bottom of the housing, there is an air inlet 118 that connects to the air reservoir and is designed to allow the entry of pressurized air from a gas canister that can be attached to the housing 102. The air inlet comprises a threaded bore for connecting to a pressurized air source.

Near the upper portion of the housing, an air outlet 108 is positioned. This outlet is linked to the air reservoir and is set up to let the pressurized air flow from the reservoir to propel the projectile. The air outlet near the top of the housing connects to the air reservoir and is designed to allow the release of this pressurized air when required to propel a projectile. The reservoir directly communicates with the air inlet and the air outlet, controlling the movement of pressurized air within the adapter. The air inlet, located near the bottom of the housing, serves as the entry point for the pressurized gas from an attached gas canister, effectively replenishing the reservoir. The air outlet may comprise substantially a rectangular shape.

In one embodiment, the operating parts of the airsoft gun may include a plunger, and a piston valve. A plunger 106 may be situated within the housing, the plunger configured to contact a piston valve 107 that is located between the air reservoir 180 and the air outlet 108. A piston valve is a device used to control the motion of a gas or fluid along a conduit by means of the linear motion of a piston within a chamber or cylinder. The piston valve 107 is designed to stop the air flow from the reservoir to the air outlet when it is in a rest position. It may be kept in the rest position using a spring that keeps the piston valve 107 in place in a bottleneck formation 182 situated between the air reservoir 180 and the air outlet 108 so that no air can pass through between the two. However, when the airsoft gun's firing pin contacts the plunger, the plunger contacts the piston valve, which puts the piston valve in the activated position. In the activated position, the piston valve has a distal portion that moves away from the bottleneck and allows temporary airflow through the bottleneck from the air reservoir to the air outlet. This high-pressure air flow powers the movements of the projectiles through and out of the airsoft gun. After being contacted by the plunger, the piston valve moves back to its rest position under the force of its spring.

Note that the piston valve 107 acts as a gatekeeper between the air reservoir and the air outlet. When at rest, it blocks the airflow from the reservoir to the outlet, ensuring that the pressurized gas only moves when the gun is fired. The piston valve 107 is triggered by contact with the plunger which is triggered by contact with the airsoft gun's firing pin, momentarily placing the piston valve in the activated position, and allowing the passage of pressurized air from the reservoir through the outlet. Note that the plunger 106, configured to contact the piston valve 107, is kept in a rest position using a spring that keeps the plunger in place. However, when the airsoft gun's firing pin contacts the plunger, the plunger is placed in the activated position and moves to contact the piston valve. After said contact, the plunger moves back to its rest position under the force of its spring.

The adapter 100 may also include a projectile inlet 120 near the bottom of the housing. This inlet is designed to let projectiles enter from an attached projectile magazine. Near the top of the housing, a projectile outlet 110 is situated. This projectile outlet is linked with the projectile inlet via a projectile conduit 181 wherein the projectile moves from the projectile inlet to the projectile outlet. The projectile outlet 110 is structured to allow the projectiles to exit towards the portion of airsoft gun where the projectile is shot out of the airsoft gun. Note the projectile inlet is strategically located near the bottom of the housing and is designed to allow the entry of projectiles from an attached projectile magazine, synchronizing the flow of projectiles with a burst of pressurized air. The projectile outlet, on the other hand, is positioned near the top of the housing, in direct connection with the projectile inlet. This allows the exit of projectiles from the airsoft gun, following the path of the pressurized air. The projectile outlet comprises a tubular feeder 190.

FIGS. 11-20 depict a second embodiment of an airsoft gun adapter 200 that also includes a housing 202, a frame 203, magazine well 205, a trigger guard 213, air inlet 218, a piston valve 207, air outlet 208, projectile inlet 220, projectile outlet 210, projectile conduit 281, air reservoir 280 and bottleneck 282. Note the second embodiment 200 does not include a grip like the first embodiment 100. Further, the projectile outlet comprises a tubular feeder 290.

FIGS. 21-30 depict a third embodiment of an airsoft gun adapter 300 that also includes a housing 302, a frame 303, magazine well 305, grip 309, a trigger guard 313, a piston valve 307, air inlet 318, air outlet 308, projectile inlet 320, projectile outlet 310, projectile conduit 381, air reservoir 380 and bottleneck 382. Note the third embodiment 300 does include a grip 309 like the first embodiment 100. Further, the projectile outlet comprises a tubular feeder 390.

FIGS. 31-40 depict a fourth embodiment of an airsoft gun adapter 400 that differs from the other embodiments 100, 200, 300 in that embodiment 400 is considered a lower element that does not include a grip, a trigger guard, a magazine well, a projectile inlet or projectile outlet element. In this fashion, embodiment 400 as a lower element is configured to be attached (via attachment point 409) to an upper element that includes a grip, a trigger guard, a magazine well, projectile inlet and projectile outlet elements. The airsoft gun adapter 400 includes a housing 402, a frame 403, air inlet 418, air inlet attachment point 419, air outlet 408, air reservoir 480 and bottleneck 482, while a piston valve (not shown) works in conjunction with the air reservoir 480 and bottleneck 482.

Each element of the adapters 100, 200, 300, 400 may be composed of injection-molded plastic, specifically types like ABS or polycarbonate. These plastics are known for their strength, rigidity, and resistance to impact, which are essential for an airsoft adapter expected to withstand the force of pressurized air and projectiles. Moreover, plastic is lightweight, making it easier for the airsoft player to maneuver the gun. Plastic's low-cost nature also makes mass production more economically viable, which is advantageous for both the manufacturer and end consumer.

3D printing technology may also be used to manufacture the adapters 100, 200, 300, 400. Each element of the adapters 100, 200, 300, 400 may be composed of 3D printing materials like thermoplastic polyurethane (TPU) or polylactic acid (PLA), allowing for rapid prototyping and even small-batch or custom production runs. This is particularly beneficial for creating adapters tailored for specific airsoft guns or user needs. 3D-printed materials can also be blended with additives such as carbon fiber or metal particles to improve their mechanical properties. Both traditional plastics and 3D-printing materials may be used for the creation of a high-performance, cost-effective airsoft adapter.

In another embodiment, each element of the adapters 100, 200, 300, 400 may be composed of metals such as aluminum, stainless steel, and titanium. Manufacturing techniques for metal components, such as CNC machining, die-casting, and metal injection molding, could be used for manufacturing.

The main advantage of the adapters 100, 200, 300, 400 over the prior art lies in their ability to seamlessly bridge the gap between different components, operating parts, gas canisters and magazines, across various airsoft gun models. Prior to the claimed embodiments, airsoft enthusiasts often faced challenges sourcing specific, potentially rare, or expensive, brand-dedicated components due to the proprietary designs of different airsoft guns. Each gun model typically accepted only a specific type of component, operating part, gas canister or magazine designed for that model. This lack of universal compatibility created not just a logistical issue but also placed constraints on the performance and versatility of the airsoft guns, as users could not freely interchange or experiment with different components to potentially improve their game.

The claimed embodiments change this by introducing a standardization previously absent in the field of airsoft guns. By offering compatibility with various components, operating parts, gas canisters and magazines, the claimed embodiments increase the flexibility of airsoft guns and allows users to choose from a wider range of components, depending on their specific needs or preferences. This can not only potentially enhance the performance of the airsoft guns but also reduce costs associated with sourcing specific components. Additionally, the claimed adapter's unique integrated design-housing, frame, grip, magazine well, trigger guard, air reservoir, air inlet, air outlet, projectile inlet, and projectile outlet-allows for a more efficient and streamlined operation, leading to a potentially improved user experience over prior models. This puts the adapters 100, 200, 300, 400 ahead of the prior art in terms of functionality, versatility, and user convenience.

Embodiments may be described above with reference to functions or acts, which comprise methods. The functions/acts noted above may occur out of the order as shown or described. For example, two functions/acts shown or described in succession may in fact be executed substantially concurrently or the functions/acts may sometimes be executed in the reverse order, depending upon the functionality/acts involved. While certain embodiments have been described, other embodiments may exist. Further, the disclosed methods' functions/acts may be modified in any manner, including by reordering functions/acts and/or inserting or deleting functions/acts, without departing from the spirit of the claimed subject matter.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An adapter for an airsoft gun, comprising:

a) a housing comprising a single, integrally formed plastic element, the housing defining a frame configured to house operating parts of the airsoft gun, the housing further including a trigger guard and a magazine well configured for mating with a projectile magazine;

b) an air reservoir located within the housing, the air reservoir for holding pressurized gas;

c) an air inlet located near a bottom of the housing, the air inlet coupled with the air reservoir and configured for allowing ingress of pressurized air from an attached gas canister;

d) an air outlet located near a top of the housing, the air outlet coupled with the air reservoir and configured for allowing egress of pressurized air from the air reservoir to the airsoft gun;

e) a projectile inlet in the magazine well of the housing, the projectile inlet configured for allowing ingress of projectiles from an attached projectile magazine; and f) a projectile outlet located near the top of the housing, the projectile outlet coupled with the projectile inlet and configured for allowing egress of projectiles from the adapter.

2. The adapter for an airsoft gun of claim 1, wherein the housing is composed of a single, 3D printed plastic element.

3. The adapter for an airsoft gun of claim 2, wherein the operating parts of the airsoft gun comprise at least a hammer, a firing mechanism, a trigger, and a barrel.

4. The adapter for an airsoft gun of claim 3, wherein the magazine well is configured to make a friction fit with the projectile magazine.

5. The adapter for an airsoft gun of claim 4, wherein the air reservoir is configured to withstand gas pressures of between 120-150 psi.

6. The adapter for an airsoft gun of claim 5, wherein the air inlet comprises a threaded bore for connecting to a pressurized air source.

7. The adapter for an airsoft gun of claim 6, wherein the operating parts of the airsoft gun comprise further comprise a piston valve located within the housing between the air reservoir and the air outlet, the piston valve configured for preventing airflow from the air reservoir to the air outlet when in the rest position and allowing temporary airflow from the air reservoir to the air outlet when contacted by a firing pin of the airsoft gun.

8. The adapter for an airsoft gun of claim 7, wherein the piston valve comprises a spring configured to keep the piston valve in the rest position.

9. The adapter for an airsoft gun of claim 8, further comprising a bottleneck passage between the air reservoir and the air outlet, wherein the piston valve rests within the bottleneck when in the rest position.

10. The adapter for an airsoft gun of claim 9, wherein the projectile outlet comprises a tubular feeder.

* * * * *